US007992517B2

(12) United States Patent
Cooper et al.

(10) Patent No.: US 7,992,517 B2
(45) Date of Patent: Aug. 9, 2011

(54) GANTRY TOWER SPRAYING SYSTEM WITH CARTRIDGE/RECEPTACLE ASSEMBLY

(75) Inventors: Steven C. Cooper, Athens, GA (US); Troy H. Cooper, Addison, TX (US); Ricky C. Croft, Dallas, TX (US)

(73) Assignee: MT Industries, Inc., Macedonia, OH (US)

( * ) Notice: Subject to any disclaimer, the term of this patent is extended or adjusted under 35 U.S.C. 154(b) by 0 days.

(21) Appl. No.: 12/686,059

(22) Filed: Jan. 12, 2010

(65) Prior Publication Data

US 2010/0175618 A1 Jul. 15, 2010

Related U.S. Application Data

(60) Division of application No. 11/413,450, filed on Apr. 28, 2006, now Pat. No. 7,886,684, which is a continuation-in-part of application No. 10/841,734, filed on May 7, 2004, now Pat. No. 7,297,211.

(60) Provisional application No. 60/469,289, filed on May 9, 2003, provisional application No. 60/676,166, filed on Apr. 29, 2005, provisional application No. 60/676,648, filed on Apr. 29, 2005.

(51) Int. Cl.
*B05C 11/10* (2006.01)

(52) U.S. Cl. ..... 118/681; 118/684; 118/323; 118/300

(58) Field of Classification Search ..... 118/679, 118/680, 681, 684, 685, 695, 696, 300, 323; 206/385; 215/100, 384, 43; 220/274, 540, 220/676; 222/165, 325, 326, 327, 89; 604/289, 604/290, 296

See application file for complete search history.

(56) References Cited

U.S. PATENT DOCUMENTS 1,982,509 A 11/1934 Frank
2,954,146 A 9/1960 Hullman (Continued)

FOREIGN PATENT DOCUMENTS

CH 167063 A 1/1934

(Continued)

OTHER PUBLICATIONS

Cooper, S. C. and Law, S. E., "Electrostatic Sprays for Sunless Tanning of the Human Body", Proceedings of the ESA-IEEE Joint Meeting on Electrostatics, 2003, pp. 1-12, University of Arkansas, Little Rock, Arkansas.

(Continued)

*Primary Examiner* — George Koch
(74) *Attorney, Agent, or Firm* — Andre M. Szuwalski; Gardere Wynne & Sewell LLP

(57) ABSTRACT

A gantry tower spraying system with a cartridge/receptacle assembly includes a gantry and a spray assembly coupled to the gantry to allow for translational movement of the spray assembly along the gantry. The spray assembly includes a receptacle for receiving a cartridge containing a cosmetic liquid for skin treatment, and a spray nozzle coupled to the receptacle for receiving the cosmetic liquid and dispensing the cosmetic liquid in a spray. The receptacle has an inner surface of a size and shape to generally conform to a size and shape of a portion of an outer surface of the cartridge. The spraying system can further be provided with an oscillation mechanism adapted to cause oscillation of the spray nozzle. The bottle can be provided with a keying mechanism for engaging a corresponding key structure of the receptacle.

39 Claims, 17 Drawing Sheets

U.S. PATENT DOCUMENTS

| | | | |
|---|---|---|---|
| 3,685,694 | A | 8/1972 | Ianelli |
| 4,004,733 | A | 1/1977 | Law |
| 4,289,276 | A | 9/1981 | Bollina et al. |
| 4,343,433 | A | 8/1982 | Sickles |
| 4,357,900 | A | 11/1982 | Buschor |
| 4,664,315 | A | 5/1987 | Parmentar et al. |
| 4,688,518 | A | 8/1987 | Missier |
| 4,731,058 | A | 3/1988 | Doan |
| 4,846,525 | A | 7/1989 | Manning |
| 4,905,904 | A | 3/1990 | Ohara et al. |
| 4,941,808 | A | 7/1990 | Qureshi et al. |
| 5,101,679 | A | 4/1992 | Smith et al. |
| 5,163,010 | A | 11/1992 | Klein et al. |
| 5,268,166 | A | 12/1993 | Barnett et al. |
| 5,277,713 | A | 1/1994 | Gelain et al. |
| 5,322,684 | A | 6/1994 | Barnett et al. |
| 5,387,200 | A | 2/1995 | Kronstadt |
| 5,460,192 | A | 10/1995 | McClain |
| 5,494,674 | A | 2/1996 | Barnett et al. |
| 5,527,564 | A | 6/1996 | Napadow et al. |
| 5,545,140 | A | 8/1996 | Conero et al. |
| 5,664,593 | A | 9/1997 | McClain |
| 5,704,554 | A | 1/1998 | Cooper et al. |
| 5,738,728 | A | 4/1998 | Tisone |
| 5,765,761 | A | 6/1998 | Law et al. |
| 5,833,751 | A | 11/1998 | Tucker |
| 5,863,497 | A | 1/1999 | Dirksing |
| 5,922,333 | A | 7/1999 | Laughlin |
| 6,003,794 | A | 12/1999 | Hartman et al. |
| 6,053,363 | A | 4/2000 | Revenu |
| 6,138,922 | A | 10/2000 | Hartman et al. |
| 6,199,557 | B1 | 3/2001 | Laughlin |
| 6,227,466 | B1 | 5/2001 | Hartman et al. |
| 6,302,122 | B1 | 10/2001 | Parker et al. |
| 6,302,662 | B1 | 10/2001 | Bensley et al. |
| 6,326,062 | B1 | 12/2001 | Noakes et al. |
| 6,387,081 | B1 | 5/2002 | Cooper |
| 6,439,481 | B2 | 8/2002 | Von Schuckmann |
| 6,443,164 | B1 | 9/2002 | Parker et al. |
| 6,491,234 | B2 | 12/2002 | Beggs |
| 6,554,208 | B1 | 4/2003 | Venuto, Sr. |
| 6,802,830 | B1 | 10/2004 | Waters et al. |
| 7,004,407 | B2 | 2/2006 | Cooper |
| 7,021,494 | B2 | 4/2006 | Mazooji et al. |
| 7,297,211 | B2 * | 11/2007 | Cooper et al. ..... 118/684 |
| 7,387,684 | B2 * | 6/2008 | Cooper et al. ..... 118/684 |
| 7,462,242 | B2 | 12/2008 | Cooper et al. |
| 2003/0127542 | A1 | 7/2003 | Cooper |
| 2004/0073186 | A1 | 4/2004 | Cameron |
| 2005/0281957 | A1 | 12/2005 | Cooper et al. |
| 2007/0197982 | A1 | 8/2007 | Thomason et al. |

FOREIGN PATENT DOCUMENTS

| | | | |
|---|---|---|---|
| EP | 0 031 649 | B1 | 9/1984 |
| EP | 0 224 352 | B1 | 8/1990 |
| EP | 0 468 736 | B1 | 3/1997 |
| EP | 0 441 501 | B1 | 8/1997 |
| EP | 1 707 502 | A1 | 10/2006 |
| WO | WO 00/54892 | | 9/2000 |
| WO | WO 2004/101165 | | 11/2004 |

OTHER PUBLICATIONS

Supplementary European Search Report , EP 06 75 1788, dated Oct. 22, 2008.

Written Opinion of the International Searching Authority, PCT/US2006/016267, Oct. 30, 2007.

EPO Search Report for EP 11152704.0 mailed Mar. 18, 2011 (7 pages).

English Translation of Claims for CH 167063 (1 page), Jan. 31, 1934.

* cited by examiner

GANTRY TOWER SPRAYING SYSTEM WITH CARTRIDGE/RECEPTACLE ASSEMBLY

CROSS-REFERENCE TO RELATED APPLICATIONS

This patent application is a division of U.S. patent application Ser. No. 11/413,450 filed Apr. 28, 2006, now U.S. Pat. No. 7,886,684,which is a continuation-in-part of U.S. patent application Ser. No. 10/841,734 filed May 7, 2004, now U.S. Pat. No. 7,297,211, which claims the benefit of U.S. Provisional Patent Application No. 60/469,289 filed May 9, 2003, wherein U.S. patent application Ser. No. 11/413,450 further claims the benefit of U.S. Provisional Patent Application No. 60/676,166 filed Apr. 29, 2005 and U.S. Provisional Patent Application No. 60/676,648, filed on Apr. 29, 2005, the disclosures of all of the foregoing applications being incorporated herein by reference.

BACKGROUND

1. Technical Field

The present invention relates to a system for uniformly delivering human body coating compositions. More particularly, one aspect of the invention relates to methods and apparatus for automating the spray coating process using a vertically traveling spray carriage to simulate motion of a handheld airbrush sprayer. Another aspect of the invention relates to a bottle having a keying mechanism for insertion into a receptacle having a corresponding key structure.

2. History of Related Art

Spray devices for the application of liquids onto human skin and hair are well known. Sprays are used for many types of medicines, hair treatments, deodorants, lotions, and cosmetic agents. The most common devices for spray applications onto the human body are hand-held sprayers, both for self-application and application by another person. Recently automated spray systems have been introduced and are used primarily by tanning salons for applications of sunless tanning liquids. Hand-held sprayers, when used correctly by a trained technician, provide the optimal tan. Automated systems allow for privacy and reduced operating costs. This present invention provides an automated system that applies spray with the motion of a handheld airbrush sprayer to achieve significantly improved results.

A primary disadvantage of hand-held air-brush systems is that it is difficult for a person to self-apply an even coat to certain body portions, such as onto the back. To achieve optimal results professional salons and spas offer trained sunless-tanning applicator personnel to apply material carefully over the entire body of the customer. A trained operator can apply a very uniform spray over the body, achieving results superior to conventional automated systems. However, this situation is often inconvenient and uncomfortable for both the personnel and the customer. In addition, since hand-held airbrush applications usually take 10 to 30 minutes, the process can be irritating to the tanning applicator and the customer due to prolonged exposure to the spray environment. Fatigue is also known to occur in the back, arms, and wrists of applicator personnel due to the repetitive motion of the hand-held air-brushing process.

Applications of cosmetic agents, such as sunless tanning compounds, with hand-held spray devices require very experienced personnel to avoid mistakes which may result in under- or over-application, missed areas, streaks, and runs. The need for the trained applicator significantly increases the cost of a sunless tan. Another drawback that limits the practicality and marketplace potential of hand-held cosmetic sprays in which an assistant is needed is the potential inconvenience and embarrassment to the person being coated, since they must stand for the duration of the application in an unclothed or partially unclothed state. A further disadvantage of hand-held air-brush systems is that the liquid containers are of an inappropriate size, often being too large or too small, to coat an entire person or selected parts of a person. In addition, the refilling process for such devices can be messy.

Automated systems for self-application of a spray mist to the entire body have recently been introduced for sunless tanning to overcome the deficiencies of hand-held applications. There is also interest in automated spray systems for medicines and decontamination agents. (See, Law and Cooper, 2000 Institute of Physics, Edinburgh, Scotland UK). These automated systems, often housed within cabinets or booths to permit enclosure of an adult, have the advantage of uniform self-application in a private setting without the need for an assistant. U.S. Pat. No. 5,922,333 to Laughlin, U.S. Pat. No. 6,387,081 to Cooper, U.S. Pat. No. 6,302,122 to Parker et al., and U.S. Pat. No. 6,443,164 to Parker et al. each describe automated systems for coating the human body in which a spray chamber is used. Several companies now manufacture these automated spray systems, to be used in tanning salons, for the purpose of more evenly applying sunless tanning compounds to the human skin. This new UV-free tanning method offers an alternative to salon customers who do not tan well in UV light or who do not wish to use conventional sun-lamp tanning beds. When used correctly, these sunless tanning systems are effective and consequently have been steadily increasing in popularity in tanning salons in many countries. The tanning solution most often used is water-based, containing up to 10% DHA (dihydroxyacetone), alcohol, aloe vera gel and coloring.

Most of these spray-tanning systems are configured within some type of booth enclosure. In current systems many nozzles are used, positioned at various angles around the subject in an effort to apply an even coating. Because of the inadequate automated coating process the customer is instructed to move through a variety of poses during the spray event which usually lasts less than a minute. Other automated spray devices for sunless tanning make use of fixed nozzles on a rotating drum to create spray movement over the subject in an effort to further enhance spray coverage. Other spray systems use vertically moving spray booms with fixed multiple nozzles, the liquid being fed to the multiple spray nozzles on the boom through a long hose connected to an electric liquid pump with an inlet from a large solution tank. In these cases several nozzles are fixed to a horizontal spray bar and the entire bar is moved. Many nozzles are needed in these systems to achieve uniform coating onto the human subject. Some systems have as many as 40 nozzles and most need at least 10 to achieve a minimally satisfactory result. In practice, the many nozzles needed cause maintenance issues that can be overwhelming for the typical salon technician and the quality of the tan is severely diminished when each of the nozzles is not spraying correctly.

U.S. Pat. No. 1,982,509 describes a sprayer carrier device which moves up and down to apply a treatment media to a body. However, U.S. Pat. No. 1,982,509 does not provide for the use of a cartridge or receptacle or removable or multiple liquid containers. Furthermore, U.S. Pat. No. 1,982,509 does provide for horizontal motion or other oscillating motion of the nozzle which is desirable to optimize spray coverage uniformity.

In present systems, several spray nozzles are fed from an electric pump from a single large tank containing sunless tanning solution. These automatic spray systems are designed to dispense approximately five to ten tanning sessions per liter of liquid, and generally use a feeder-tank capacity of eight to twenty liters. Since each customer's dose is drawn from a common tank, the customer has no assurance of the amount applied, nor do they have a choice of the type of lotion to be applied for a certain skin type or desired tanning color. It is not currently practical to adapt present automatic systems to dispense a single dosage from an individually sized container because of the wasted volume of spray liquid that resides in the many hoses that are required to feed each of the many spray nozzles. These systems also use electrically operated liquid pumps which are impractical to adapt for a cartridge system due to the need to purge the pump and pump lines between spray sessions.

The various embodiments of the present invention provide for a self-application spray device having an insertable, lower volume liquid container closely connected to a nozzle system and of a size allowing a customer to dispense an appropriate volume of spray solution of their choice. In addition the present invention provides for automatic motion of the nozzle to simulate that which is achieved by a hand-held spraying device.

SUMMARY OF THE INVENTION

One aspect of the invention is directed to a keyed bottle for engagement with a receptacle, in which the keyed bottle includes a bottle body for containing a cosmetic liquid for skin treatment and a cap having a base portion for engaging a portion of the bottle body and an opening for dispensing the cosmetic liquid from the bottle body. The keyed bottle further includes a keying mechanism longitudinally extending along at least a portion of the bottle body, the keying mechanism for engaging a key structure of the receptacle, the key structure being of a size and shape to conform to the size and shape of the keying mechanism.

Another aspect of the invention is directed to a receptacle for engagement with a keyed bottle containing a cosmetic liquid for skin treatment. The receptacle includes a receptacle body having an inner surface defined by a central bore, the inner surface being of a size and shape to generally conform to the size and shape of the keyed bottle. The receptacle body further includes a chamber portion located above a base of the central bore for receiving the contents of the keyed bottle upon insertion of the keyed bottle into the receptacle body. The receptacle body further includes a fluid channel for conveying the cosmetic liquid from the chamber portion to a spray nozzle. The receptacle further includes a key structure extending along a portion of the inner surface, the key structure for engaging a keying mechanism of the keyed bottle. The keying mechanism is of a size and shape to conform to the size and shape of the key structure.

Still another aspect of the invention is directed to a spray system for dispensing a cosmetic liquid for skin treatment including a receptacle for engagement with a bottle containing a cosmetic liquid for skin treatment, a spray nozzle coupled to the receptacle for receiving the cosmetic liquid from the receptacle and dispensing the cosmetic liquid in a spray, and a housing for containing at least a portion of the receptacle and at least a portion of the spray nozzle. The spray system further includes an oscillation and translation mechanism coupled to the housing and the spray nozzle. The oscillation and translation mechanism is adapted to cause translational movement of the housing and oscillation of the spray nozzle.

Still another aspect of the invention is directed to a spray system for dispensing a cosmetic liquid for skin treatment including a gantry, and a spray assembly coupled to the gantry and adapted for translational movement along the gantry. The spray assembly includes a cartridge having an outer surface and containing a cosmetic liquid for skin treatment, and a receptacle for receiving the cartridge, the receptacle having an inner surface of a size and shape to generally conform to a size and shape of a portion of the outer surface of the cartridge. The spray system further includes a spray nozzle closely coupled to the receptacle for receiving the cosmetic liquid from the receptacle and dispensing the cosmetic liquid in a spray.

Still another aspect of the invention is directed to a spray system for dispensing a cosmetic liquid for skin treatment including a gantry, and a spray assembly coupled to the gantry and adapted for translational movement along the gantry in a first direction. The spray assembly includes a cartridge having an outer surface, the cartridge for containing a cosmetic liquid for skin treatment, a housing, and a receptacle contained within at least a portion of the housing for receiving the cartridge. The receptacle having an inner surface of a size and shape to generally conform to a size and shape of a portion of the outer surface of the cartridge. The spray assembly further includes a spray nozzle pivotally mounted within at least a portion of the housing, the spray nozzle being coupled to the receptacle for receiving the cosmetic fluid from the receptacle and dispensing the cosmetic fluid in a spray in at least a second direction.

The above summary of the invention is not intended to represent each embodiment or every aspect of the present invention.

BRIEF DESCRIPTION OF THE DRAWINGS

A more complete understanding of the method and system of the present invention may be obtained by reference to the following Detailed Description when taken in conjunction with the accompanying Drawings wherein.

DETAILED DESCRIPTION OF THE DRAWINGS

Embodiment(s) of the invention will now be described more fully with reference to the accompanying Drawings. The invention may, however, be embodied in many different forms and should not be construed as limited to the embodiment(s) set forth herein. The invention should only be considered limited by the claims and the equivalents thereof With reference now to FIG. 1, there is shown an exploded perspective view of a keyed bottle 10, or keyed cartridge, in accordance with an embodiment of the present invention. The bottle 10 is a collection of several parts that may be assembled together.

Figure 1:
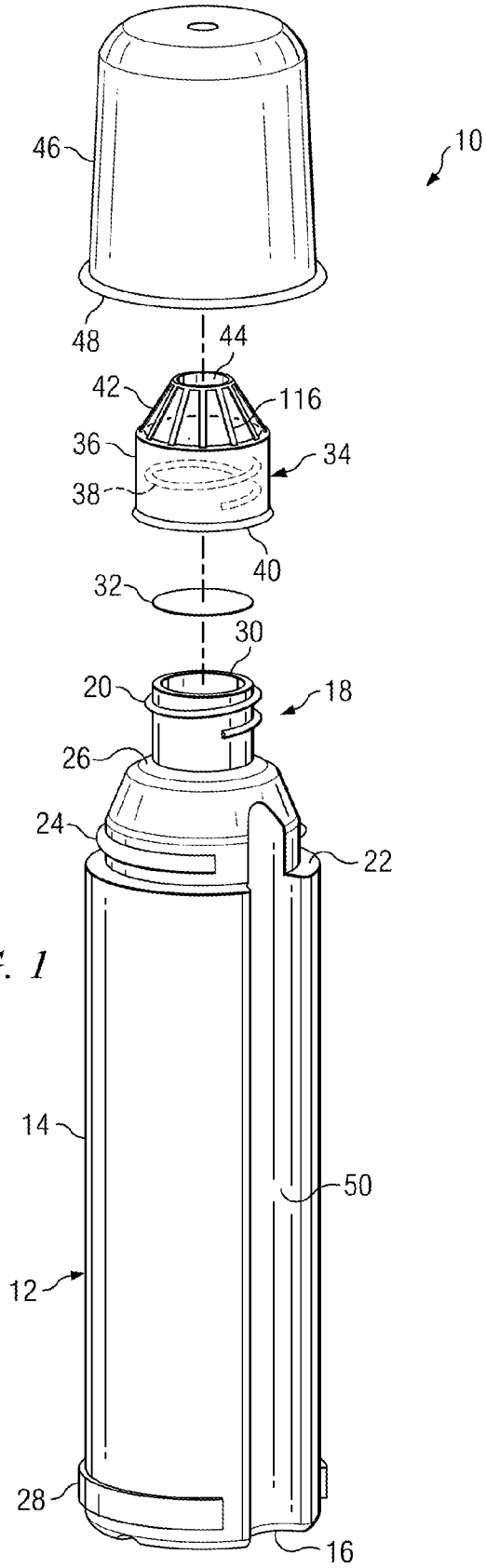
FIG. 1 is an exploded perspective view of a keyed bottle in accordance with an embodiment of the present invention.

First, the bottle 10 includes a bottle body 12. The bottle body 12 is generally cylindrical in shape. Although a generally circular cross-sectional bottle body 12 is illustrated in FIG. 1, it will be understood that the bottle body 12 may have any one of a number of possible shapes and configurations provided the shape and configuration of the bottle body supports the keyed feature to be described below in more detail. As an example, the bottle body 12 may have a square, rectangular, ovular, polygonal, or other suitable geometric cross-sectional shape. It will further be understood that the cross-sectional shape itself may comprise and/or support the keyed feature to be described below in more detail. The bottle body 12 includes a side wall portion 14 and a base portion 16. The side wall and base portions, 14 and 16, define a fluid/liquid container. Longitudinally opposite the base portion 16 is a neck portion 18 of the bottle body 12. It will be noted in a preferred implementation that the generally cylindrical bottle body 12 narrows in diameter towards the neck portion 18. The neck portion 18 is similarly cylindrically shaped and more particularly has a circularly-shaped cross-section. One or more externally positioned threads 20 are formed on the external cylindrical/circular surface of the neck portion 18 for use in assembling the parts of the bottle 10 in a manner to be described below. A first seat 22 is provided at the point where the generally cylindrical bottle body 12 narrows in diameter towards the neck portion 18. Just above the first seat 22, on an exterior surface of the narrowing bottle body 12 is formed a friction ring 24 for use in assembling the parts of the bottle 10 in a manner to be described below. Above the friction ring 24, a second seat 26 is provided at a point below the location where the externally positioned threads 20 are formed on the external cylindrical/circular surface of the neck portion 18. Near the base portion 16, a set of friction rings 28 are formed on the external cylindrical/circular surface of side wall portion 14. These friction rings 28 assist in user handling and manipulation of the bottle 10, generally, and the bottle body 12, specifically, so as to inhibit slipping from a grasping user hand. The neck portion 18 terminates in a cylindrical/circular rim 30. The bottle may be sized to hold any desired volume of fluid/liquid, but in a preferred implementation is sized (and shaped) so that it can easily be manipulated by hand. In a preferred implementation, volumes at or less than 1 liter are envisioned. In another preferred implementation, volumes of less than about 500 milliliters are envisioned. In a most preferred implementation, volumes that do not exceed an amount of fluid/liquid needed for a single (one-time) use or application of the fluid/liquid are envisioned. In this most preferred implementation, the bottle 10 is a disposable, single use commodity not intended for refill. In a preferred implementation, the bottle 10 is a cartridge or bottle for use in a cosmetic device for spraying skin with a skin treatment media, such as a sunless tanning compound or other cosmetic materials. In still other embodiments the bottle 10 or cartridge can be refillable or reusable.

Second, the bottle 10 includes a seal 32 that is affixed, following filling of the bottle body 12 with fluid/liquid, to the rim 30 of the neck portion 18. Any suitable sealant, glue or adhesive may be used to affix the seal 32 to the rim 30. The seal 32 can be of any suitable thickness that resists inadvertent puncturing or tearing. Once affixed, the seal 32 should function to prevent leakage of fluid/liquid from the bottle body 12. The seal 32 can be made of any suitable material such as foil, plastic, paper, or other materials that can be readily punctured upon insertion into a receptacle or receiver.

Third, the bottle 10 includes an open cap 34. A base portion 36 of the open cap 34 is generally cylindrically/circularly shaped and is sized such than an inner diameter is slightly larger than an exterior diameter of the neck portion 18 of the bottle body 12. One or more internally positioned threads (shown in phantom dotted lines 38) are formed on the internal cylindrical/circular surface of the base portion 36. These threads 38 complement and engage the threads 20 formed on the outer surface of the neck portion 18. Thus, the open cap 34 may be screwed onto the bottle body 12 when assembling the parts of the bottle 10 together. When assembled in this fashion, a bottom edge 40 of the open cap 34 may seat on the second seat 26 of the bottle body 12 so as to prevent over-tightening of the open cap 34 and deformation damage to either the neck portion 18 or the affixed seal 32. While FIG. 1 shows a threaded assembly means, it will be understood that the open cap 34 may be assembled to neck portion 18 of the bottle body 12 by any other suitable means including means which permit only a single such assembly such that the assembly means (or the cap 34 itself) is destroyed or rendered not optimally useful in the event the open cap 34 is removed following an initial filling and emptying, such as spin welded, thermal sealed, adhesive sealed, or press fit, etc. Such assembly means would accordingly support the most preferred implementation where the bottle 10 is a disposable, single use commodity not intended for refill. The generally cylindrical/circular shape of the open cap 34 tapers in a generally conical fashion towards a front end portion 42 and terminates at an opening 44. It is only through the opening 44 that access to the seal 32 (and thus to the fluid/liquid retained in the bottle body 12) is provided during normal use of the bottle 10.

Fourth, the bottle 10 includes an enclosing cap 46 that is generally cylindrical in shape. Although a generally circular cross-sectional shape is illustrated in FIG. 1, it will be understood that the enclosing cap 46 may have any one of a number of possible shapes and configurations, and will most likely have a shape and configuration that complements the shape and configuration of the bottle body 12. The enclosing cap 46 need not, however, in a preferred implementation, support, include or account for the keyed feature to be described below in more detail. The enclosing cap 46 is sized such than an inner diameter is substantially the same as an exterior diameter of the friction ring 24 provided on the outer surface of the neck portion 18 of the bottle body 12. Thus, when the enclosing cap 46 is placed over the neck portion 18 of the bottle body 12, a friction engagement is formed to retain the enclosing cap in place. Alternatively, a complementary ring or channel may be formed on the inner surface of the cap 46 to engage with the friction ring 24 when the bottle 10 is assembled. When assembled in either fashion, a bottom edge 48 of the enclosing cap 46 may seat on the first seat 22 of the bottle body 12. An exterior diameter of the enclosing cap 46 may preferably be substantially the same as an outer diameter of the bottle body 12 at the location of the first seat 22.

The bottle 10 further includes a keyed feature designed to ensure use of only bottles having a certain keyed shape in a given application. This keyed feature provides important advantages for a number of reasons. One reason is that bottles may contain different fluids/liquids (or perhaps different volumes of a fluid/liquid). By keying the bottles one may ensure that only the proper fluid/liquid (or proper volume) is used in that given application matching to that key. Spraying of an incorrect fluid can cause malfunction of spray nozzles such as clogging or incorrect flow rates. Another reason may be that fluid/liquid can be obtained from different vendors. By keying the bottles one may ensure that only the fluid/liquid from a certain vendor is used in that given application matched to that key. A further advantage provided by the keyed feature is ensuring correct orientation of the bottle within a receiver or receptacle. A still further advantage provided by the keyed feature is that it ensures that the correct bottle is used for a particular spray device. Another advantage provided by the keyed feature is that rotation of the bottle (or cartridge) within the receptacle is prevented.

Figure 2A:
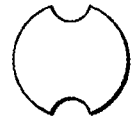
FIGS. 2A-2F illustrate cross-sectional shape examples for the bottle body which includes keying features.

In an exemplary implementation illustrated in FIG. 1, the bottle 10 includes a keyed feature in the form of a longitudinally extending channel 50 formed in the exterior surface of the generally cylindrical bottle body 12. It will be noted that the rings 24 and 28 as well as the seat 22 on the bottle body 12 do not interfere with the provision of the channel 50. This channel 50 is shown to have a hemispherical cross-sectional shape, but it will be understood that the channel can have any desired or suitable shape including, for example, square (FIG. 2E), rectangular, polygonal, triangular, and the like. Still further, although FIG. 1 illustrates the presence of just a single channel 50, it will be understood that the keyed feature used on the bottle 10 may alternatively include two or more channels (FIGS. 2A, 2E) and further that there need not be included an even spacing of the two or more channels about the perimeter of the bottle body 12 (FIG. 2E). While longitudinally extending channels may be preferred, it will further be recognized that the one or more channels may instead spiral in a thread-like fashion, with the keying provided through a matching threaded ridge where the bottle is received. The keyed feature also need not fully extend along the longitudinal length of the outer surface of the bottle body 12.

Figure 2B:
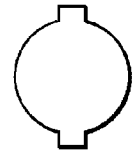
Figure 2C:
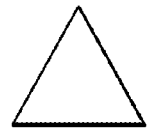
Figure 2D:
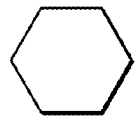
Figure 2E:
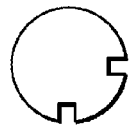
Figure 2F:
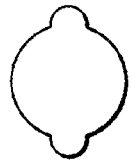

While a preferred implementation utilizes a channel 50, it will be understood that the keyed feature used on the bottle 10 may alternatively comprise the use of one or more longitudinally extending raised ridges formed on the exterior surface of the generally cylindrical bottle body 12 (FIGS. 2B and 2F). While longitudinally extending ridges may be preferred, it will further be recognized that the one or more raised ridges may instead spiral in a thread-like fashion, with the keying provided through a matching threaded channel where the bottle is received.

It was further mentioned previously that the geometric cross-sectional shape of the bottle body 12 itself may comprise and/or support the keyed feature (FIGS. 2C and 2D). In this regard, keying is provided by having a complementarily shaped receptacle for the bottle.

Other keying mechanisms, known to those skilled in the art, may alternatively be used in connection with the bottle 10.

It will further be recognized by those skilled in the art that the use of a longitudinally extending channel or ridge provides a convenient alignment guide on the bottle body 12 so as to facilitate the placement of a label or the printing of markings on the outside surface of the bottle body 12.

The bottle body 12 and caps 34 and 46 of the keyed bottle 10 are preferably made from a molded plastic (for example, a thermoplastic) material in any suitable color and with any desired surface textures or features.

Figure 3:
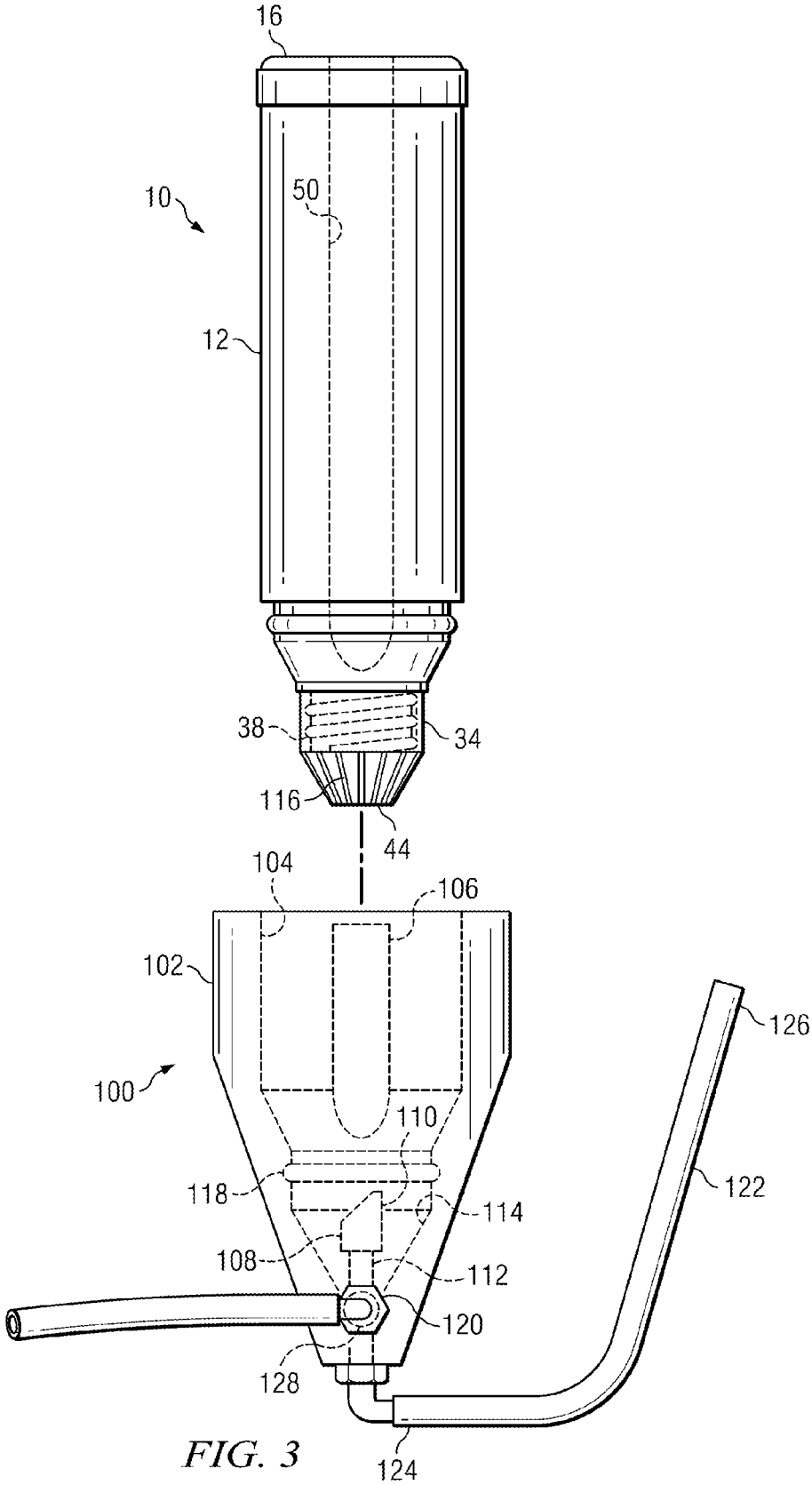
FIG. 3 is a transparent side view of a receptacle for receiving a keyed bottle.
Figure 4:
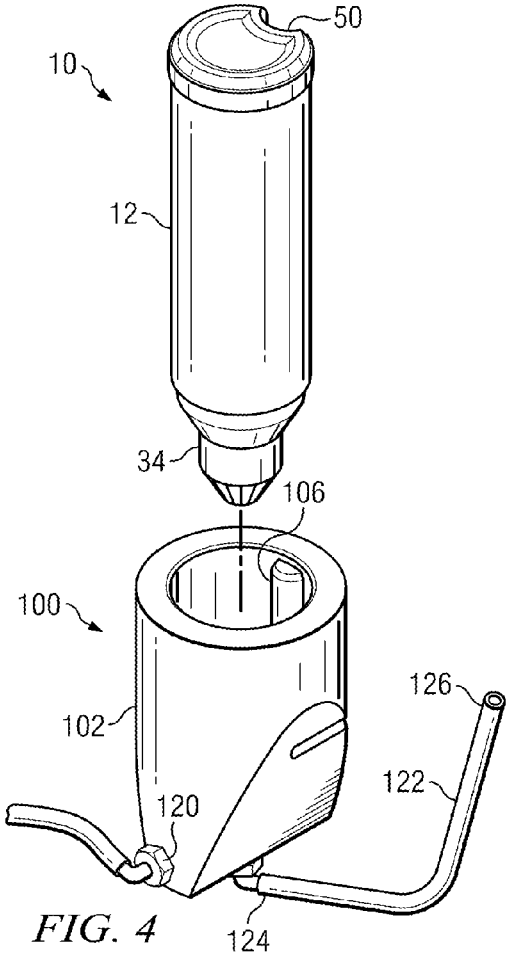
FIG. 4 is a solid perspective view of the receptacle and keyed bottle shown in FIG. 3.
Figure 5:
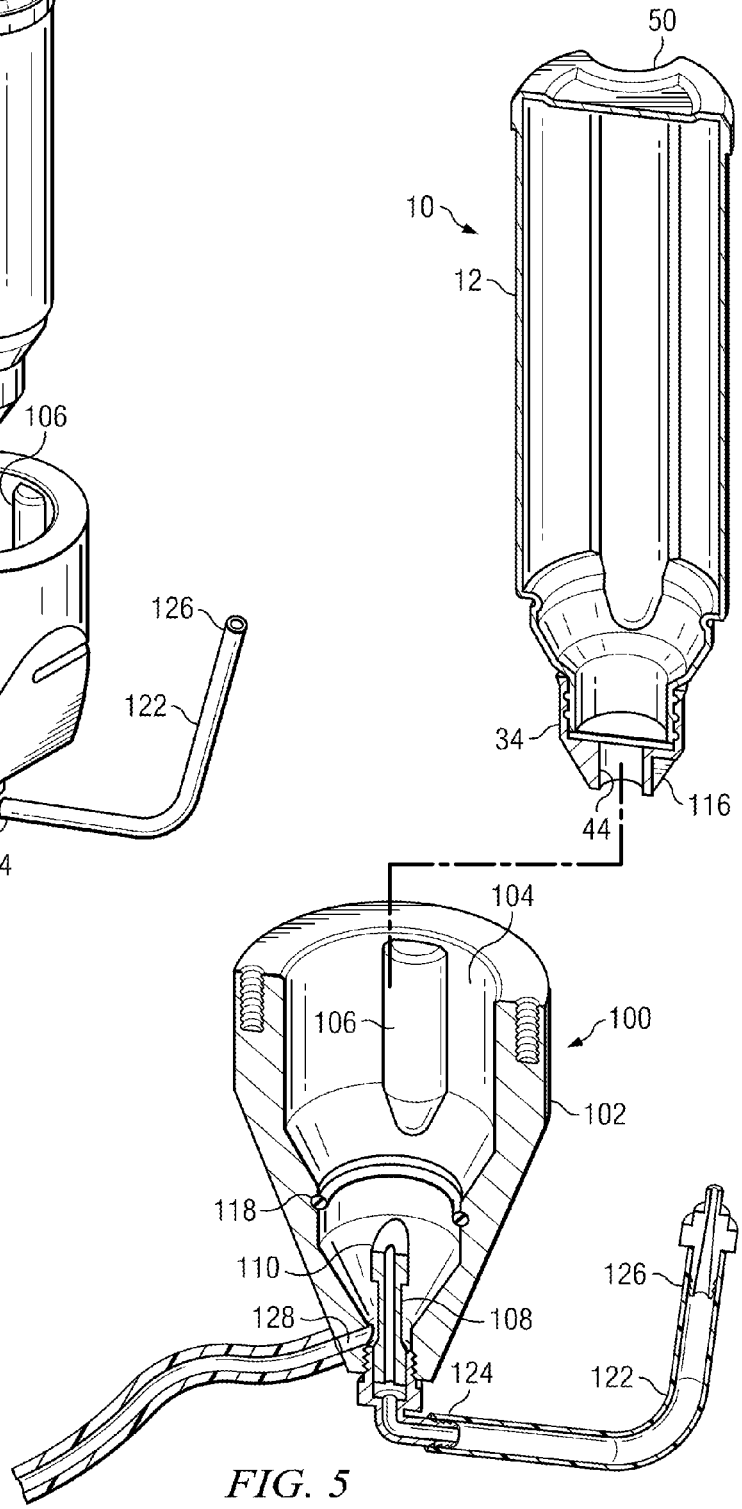
FIG. 5 is a solid sectioned view of the receptacle and keyed bottle of FIG. 3.
Figure 6A:
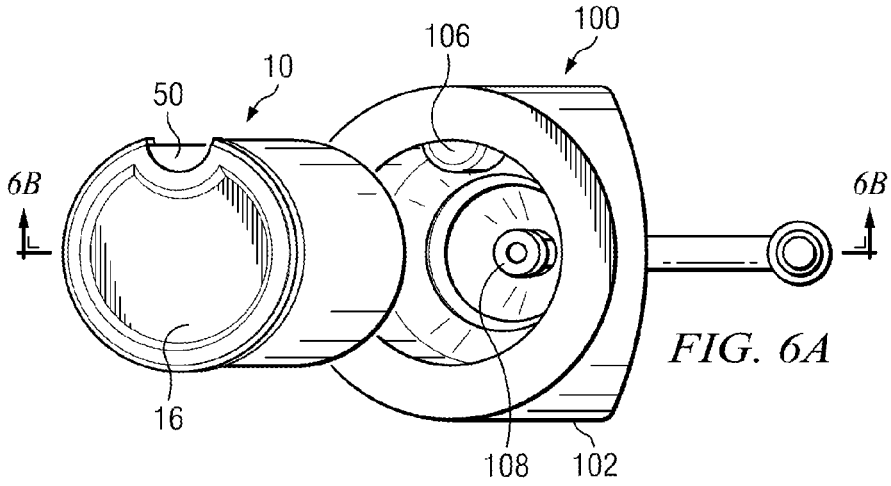
FIG. 6A is a solid perspective view of the receptacle and keyed bottle of FIG. 3.
Figure 6B:
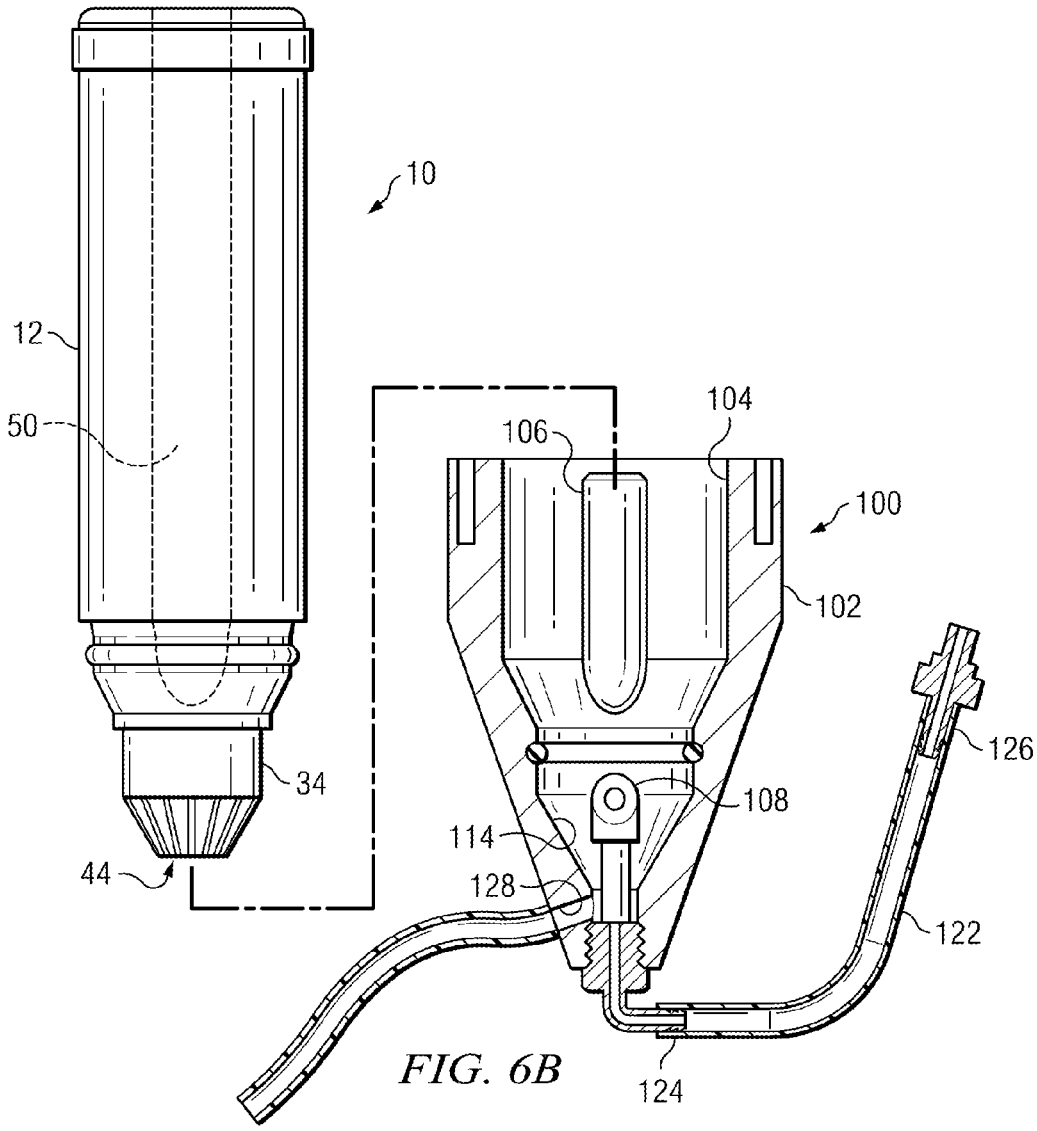
FIG. 6B is a side view of a section A-A of the receptacle and keyed bottle of FIG. 6A.
Figure 7A:
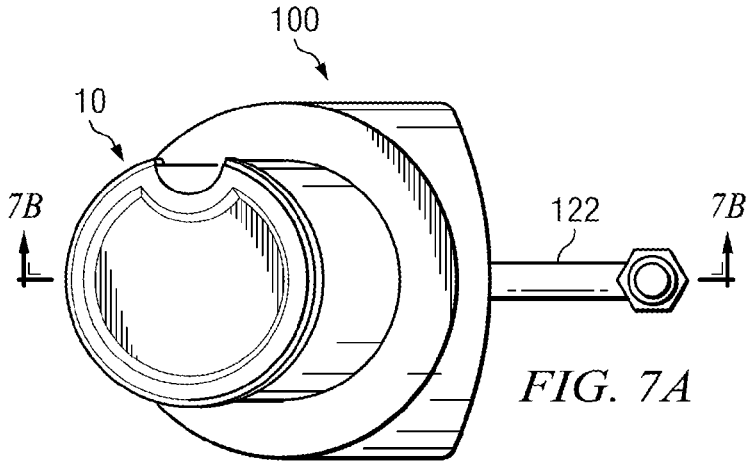
FIG. 7A is a solid perspective view of the receptacle and keyed bottle of FIG. 3 with the keyed bottle inserted.
Figure 7B:
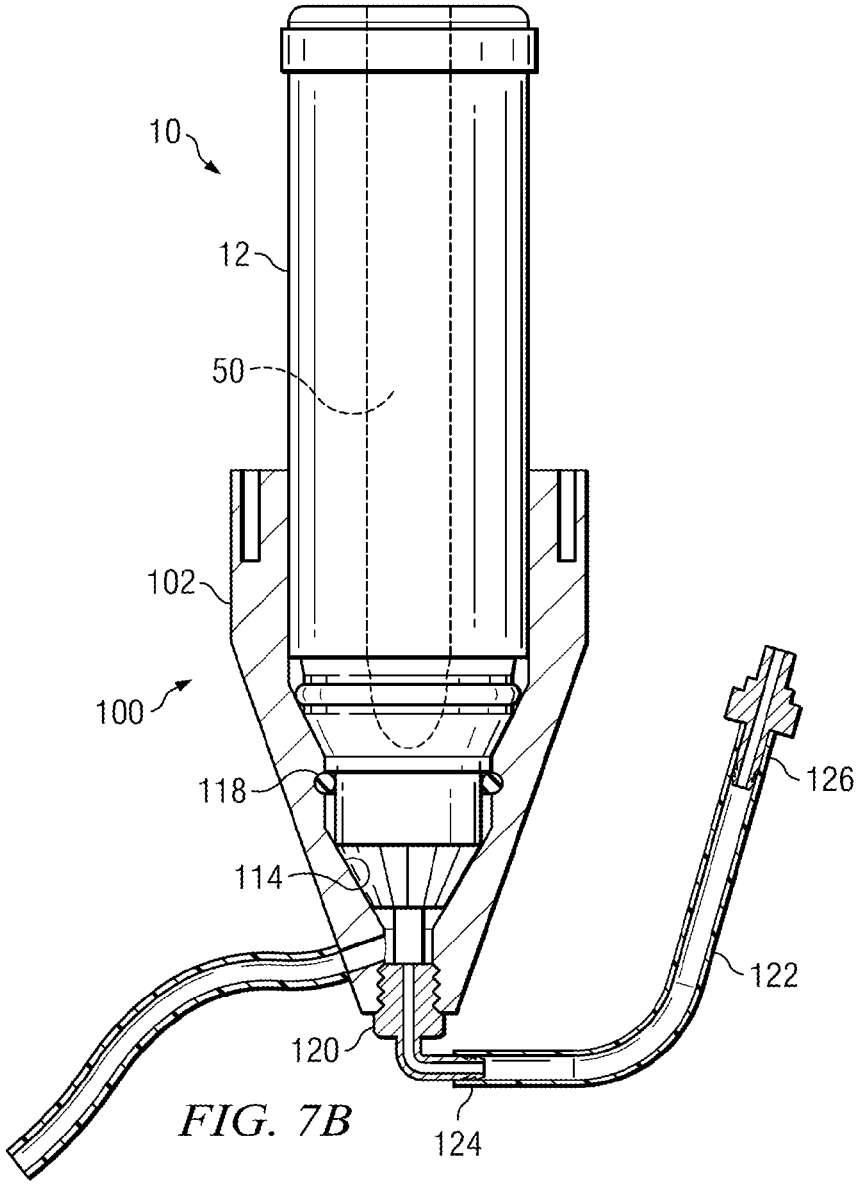
FIG. 7B is a side view of a section A-A of the receptacle and keyed bottle of FIG. 7A.

Reference is now made to FIG. 3 wherein there is shown a transparent side view of a receptacle 100 for receiving a keyed bottle 10. In accordance with an embodiment of the present invention, the receptacle 100 is of an inside shape such that it mates with the outside shape of the keyed bottle 10 to properly orient the keyed bottle 10 within the receptacle 100, as well as to ensure that the correct bottle is used. FIG. 4 is a solid perspective view of the receptacle and keyed bottle shown in FIG. 3. FIG. 5 is a solid sectioned view of the receptacle and keyed bottle of FIG. 3. FIG. 6A is a solid perspective view of the receptacle and keyed bottle of FIG. 3. FIG. 6B is a side view of a section A-A of the receptacle and keyed bottle of FIG. 6A. FIG. 7A is a solid perspective view of the receptacle and keyed bottle of FIG. 3 with the keyed bottle inserted. FIG. 7B is a side view of a section A-A of the receptacle and keyed bottle of FIG. 7A.

The receptacle 100 comprises a generally cylindrically-shaped receptacle body 102 having a central bore 104 sized and shaped to generally conform to the size and shape of the keyed bottle body 12 with open cap 34. The central bore 104 is accordingly suited to comfortably, but precisely, receive the keyed bottle body 12 with open cap 34. Again, the geometric cross-sectional shape of the central bore 104 should preferably be designed to as to match the shape of the bottle body 12 to be received. In this way, the central bore 104 assists in the keyed bottle 10 operation discussed above.

Arranged within the receptacle body 102 is a key structure 106 that is sized and shaped to conform to the size and shape of the key feature on the bottle body 12. In the exemplary implementation shown in FIG. 3, the key structure 106 comprises a cylindrical rod for forming a ridge with an exposed hemispherical surface. When the keyed bottle body 12 with open cap 34 is inserted within the central bore 104, the hemispherical channel 50 (see, FIG. 1) must be aligned with the key structure 106 in order for the keyed bottle body 12 with open cap 34 to be fully and correctly received. A bottle having a size and/or shape different than that of the central bore 104, or which fails to have (or has a different) keyed feature than that provided by the key structure 106, will not be properly received by the receptacle 100. In this way, differently keyed bottles may contain different fluids/liquids (or perhaps different volumes of a fluid/liquid), and the receptacle body 102 with bore 104 and key structure 106 will ensure that only the proper fluid/liquid (or proper volume) whose bottle matches is received. Similarly, a particularly keyed bottle can be provided to contain fluid/liquid from an authorized vendor, and the receptacle body 102 with bore 104 and key structure 106 will ensure that only matching bottles from that authorized vendor will be received.

At a base of the bore 104, a hollow needle 108 is provided which is oriented so as to puncture the seal 32 (see, FIG. 1) attached to the bottle body 12 when a properly keyed bottle body 12 with open cap 34 is received by the receptacle 100. The seal 32 ensures fresh material until the seal 32 is punctured. Self tanning compounds, for example, are known to degrade over time when exposed to air. The hollow needle 108 has a distal end 110 having a wider outer diameter than a shaft portion 112. The wider distal end 110 of the needle 108 passes through the opening 44 in the open cap 34 and punctures at least a correspondingly sized hole in seal 32. Because the punctured hole in the seal 32 is wider than the diameter of the shaft 112, fluid/liquid contained within the bottle body will be allowed to drain out into a chamber portion 114 of the bore 104 located just above the base of the bore. With reference to FIG. 1, it will be noted that the conically-shaped front end portion 42 of the open cap 34 includes a plurality of longitudinal ridges 116 which define a number of open spaces between the ridges adjacent the outer surface of the open cap in the area of the chamber portion 114. These open spaces permit additional fluid/liquid to drain from the bottle body 12 and pool in the chamber portion 114 at the base of the bore 104. An o-ring seal 118 positioned at a top of the chamber portion 114 at the base of the bore 104 serves to seal against the base portion 36 of the open cap 34 when the bottle 10 is inserted and thus control the amount of fluid/liquid which is allowed to drain from the bottle body 12 by preventing the draining liquid from trying to fill available open space within the bore 104.

The needle 108 is connected to a fitting 120 mounted at the bottom of the receptacle body 102. A vent tube 122 is coupled at a first end 124 thereof to the fitting 120. The vent tube 122 has sufficient length such that a second end 126 thereof can be positioned at least above the position of the o-ring 118, and even more preferably above the top of the receptacle 100. Through the fitting 120, an open air communication channel is formed between the second end 126 of the vent tube 122 and the wider distal end 110 of the needle 108. This allows air to enter into the bottle body 12 following puncturing of the seal 32 and thus facilitate smooth draining of the fluid/liquid into the chamber portion 114 at the base of the bore 104.

A fluid channel 128 is formed from outside the receptacle body 102 through to the chamber portion 114 at the base of the bore 104. This fluid channel 128 allows the fluid/liquid which has pooled in the chamber portion 114 at the base of the bore 104 to be drained therefrom. An appropriate fitting (not shown) may be inserted into the fluid channel 128 to facilitate the connection of desired plumbing for purposes of conveying the drained fluid/liquid. The plumbing connected thereto may, depending on implementation, utilize suctioning, siphoning, pumping, and other known methods of fluid/liquid conveyance.

Figure 8:
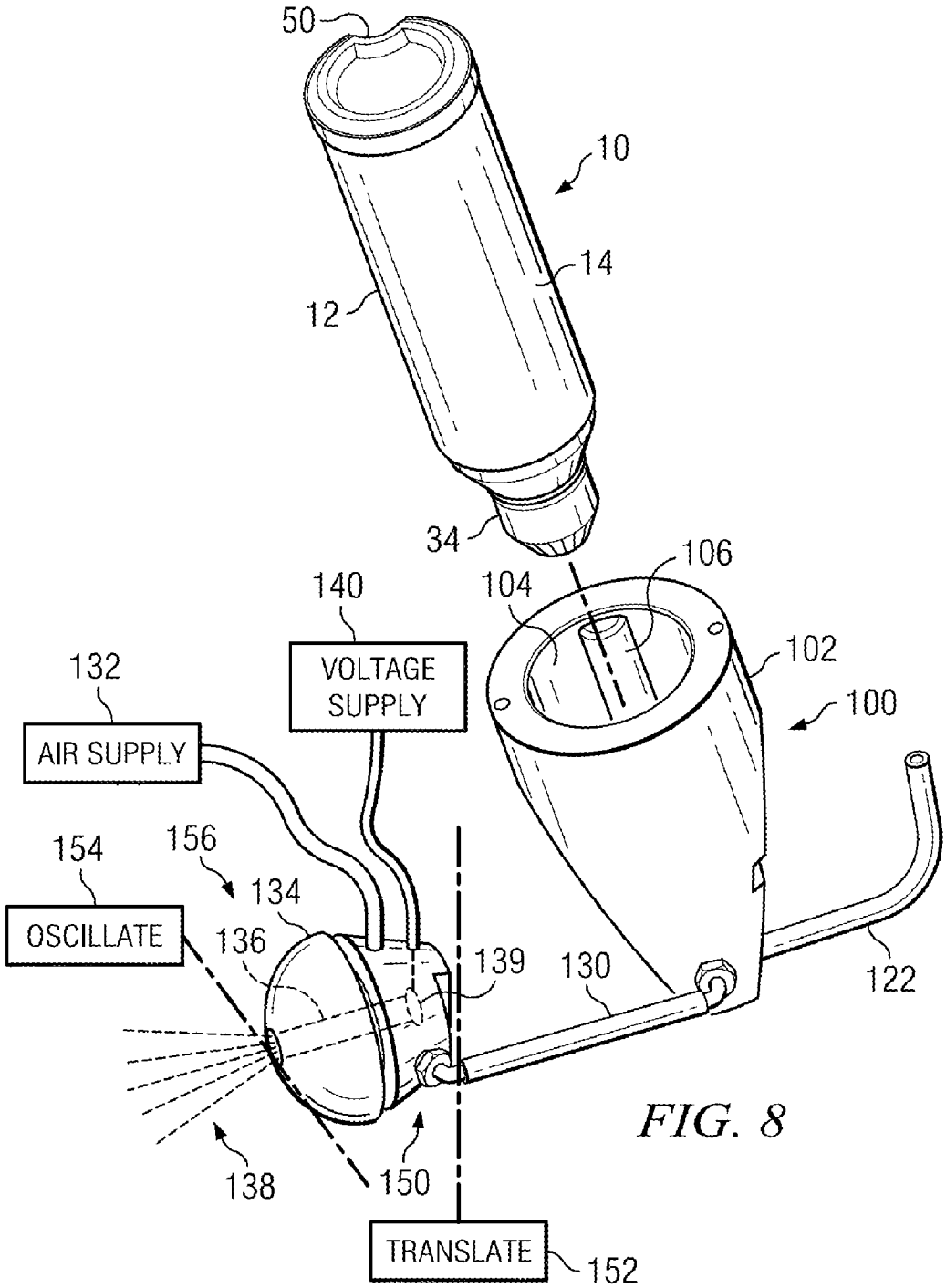
FIG. 8 is a solid perspective view of the structure shown in FIG. 3 showing connection of a spraying system.

With specific reference now to FIG. 8, in a preferred implementation, removal of fluid/liquid which has pooled in the chamber portion 114 at the base of the bore 104 of the receptacle 100 is accomplished through venturi suctioning. One end of a tube 130 is connected using an appropriately selected fitting (not shown) to the fluid channel 128. An opposite end of the tube 130 is connected to a fluid entry point of a spray nozzle 134. An air supply 132 supplies air (or other appropriately selected gas) to the spray nozzle 134, with the supplied air being mixed with the liquid drawn by venturi effect from the receptacle 100 in an atomization chamber 136 to form a spray cloud 138. In a preferred embodiment, the spray nozzle 134 is an electrostatic nozzle (for example, a nozzle supplied by Electrostatic Spray Systems or Mystic Tan, or the nozzle disclosed by U.S. Pat. Nos. 5,704,554 and 5,765,761, or U.S. patent application Ser. No. 11/272,274 filed Nov. 10, 2005 and Ser. No. 11/271,257 filed Nov. 10, 2005, the disclosures of each of which being incorporated herein by reference). A voltage supply 140 accordingly supplies a charging voltage to the nozzle for induction charging of the spray cloud 138 through an electrode 139. In an alternative embodiment, contact charging may be performed with respect to the fluid/liquid which has pooled in the chamber portion 114 at the base of the bore 104. In accordance with an embodiment of the invention, the tube 130 from the fluid channel 128 to the spray nozzle 134 is of a relatively short length such that the fluid channel is quickly purged upon removal of a first bottle from the receptacle and another bottle is inserted in its placed in the receptacle and spraying is initiated. The relative short length of the tube 130 also provides for a reduction in the amount of wasted fluid which may remain in the tube 130 after spraying.

In a preferred application, a mechanism 150 is provided to cause the nozzle 134 to translate 152 along a given path and oscillate 154 while being transported along that given path. A spraying system 156 is accordingly formed. In a preferred implementation, the spraying system 156 is adapted to spray a solution (contained in the bottle 10) over the surface of a human body. More specifically, the solution may comprise a sunless tanning compound or other skin treatment formulation (such as a moisturizer, medicine, decontaminate or sun screen). The translation 152 of the nozzle 134 would accordingly preferably occur in the vertical direction so as to facilitate covering a person from head to toe with the sprayed solution. The oscillation 154 of the nozzle 134 would accordingly preferably occur in the horizontal direction (perpendicular to the translation direction) so as to facilitate a more even distribution of the spray solution and thus a more even coverage across the skin surface. In accordance with various embodiments, the translation and oscillation mechanism 150 can include one or more motors having a chain drive, belt drive, screw drive, gear drive, rack and pinion, etc. In still other embodiments, the translation and oscillation mechanism can use air or hydraulic drive mechanisms.

In the most preferred embodiment, the spraying system 156 would receive a bottle 10 containing a volume that does not exceed an amount of fluid/liquid needed for a single (one-time) use or application of the fluid/liquid. The spraying system would then be actuated to spray that fluid/liquid to cover a human body. Following spraying the fluid/liquid would be exhausted and the bottle would be disposed of Although the tower sprayer 200 in the presently described embodiment is described as using a keyed bottle 10, it should be understood in other embodiments that a bottle could be used that is not keyed. In still other embodiments, the keyed bottle 10 and receptacle 100 could be replaced by a tank having a connection to the nozzle 134 by a hose.

Figure 9A:
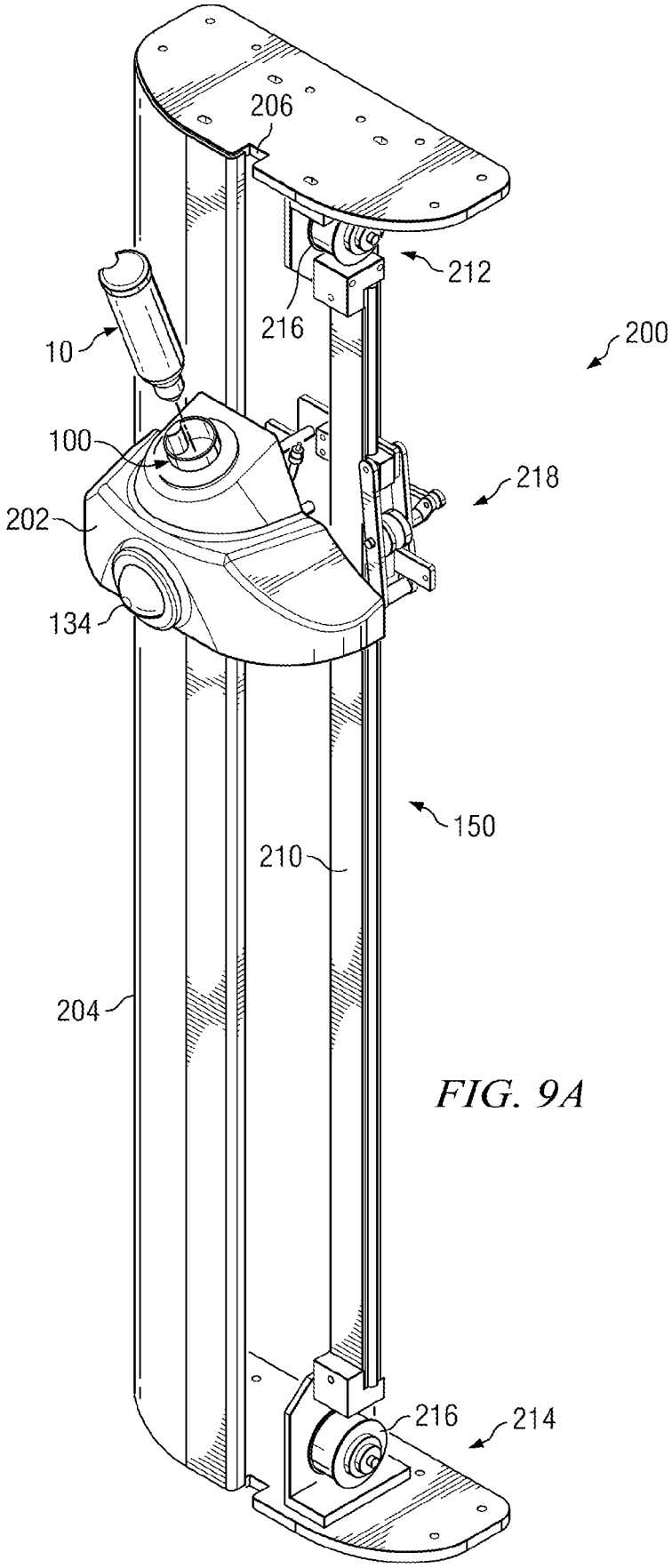
FIG. 9A is a frontal perspective view of a tower sprayer in accordance with an embodiment of the invention.
Figure 11A:
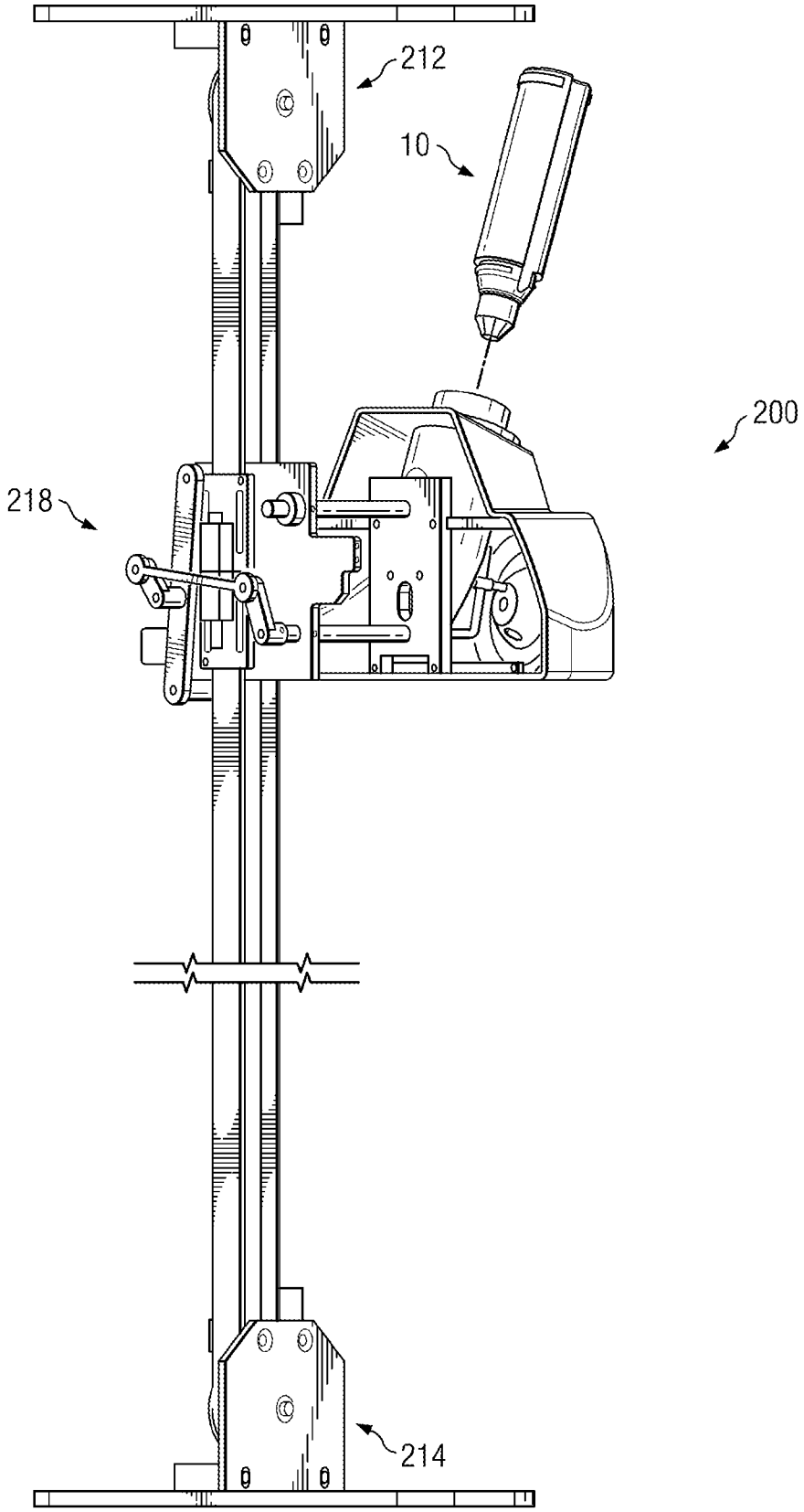
FIG. 11A is a rearward perspective view of the tower sprayer of FIG. 9A.
Figure 11B:
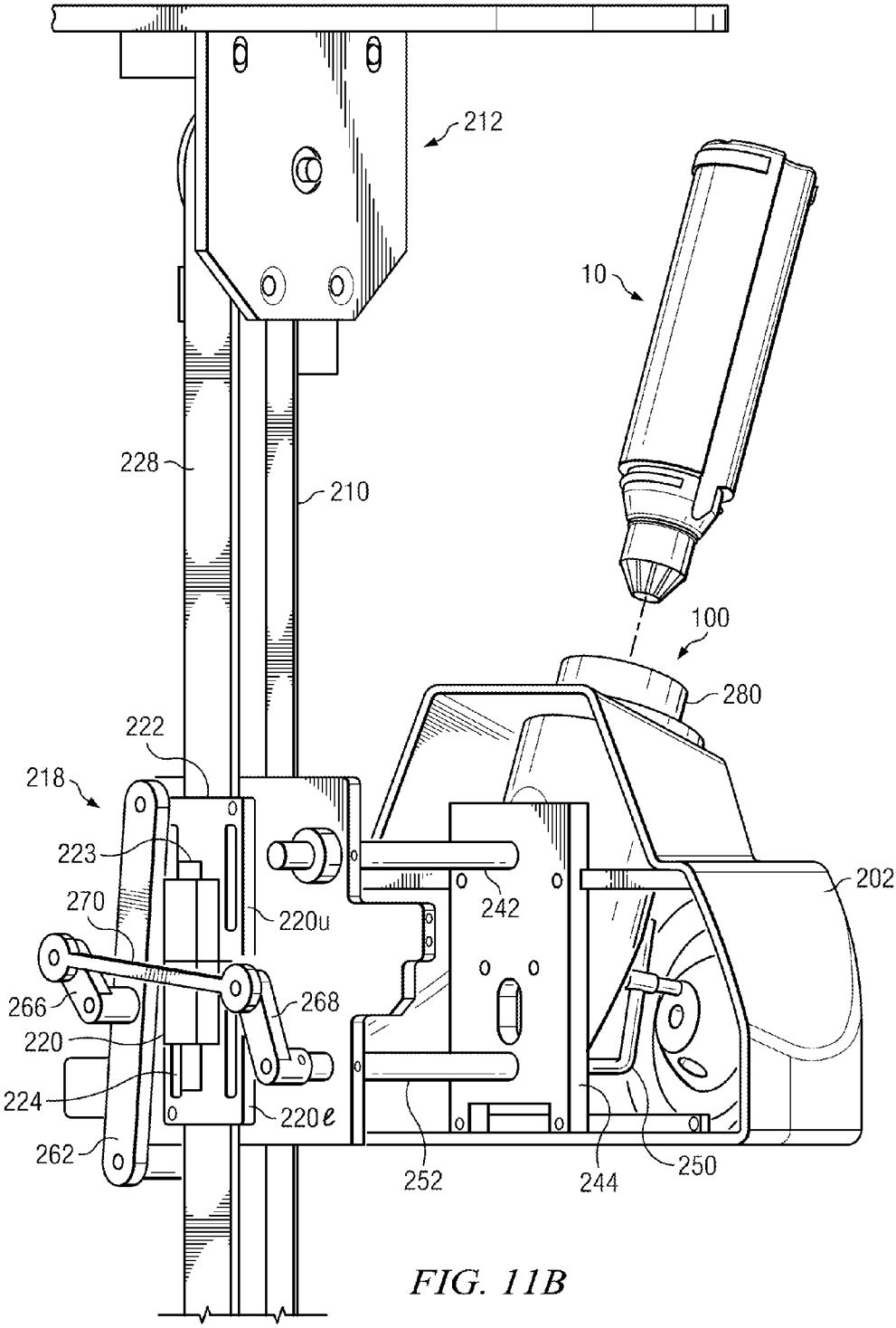
FIG. 11B is a close-up rearward perspective view of the tower sprayer of FIG. 11A.
Figure 12:
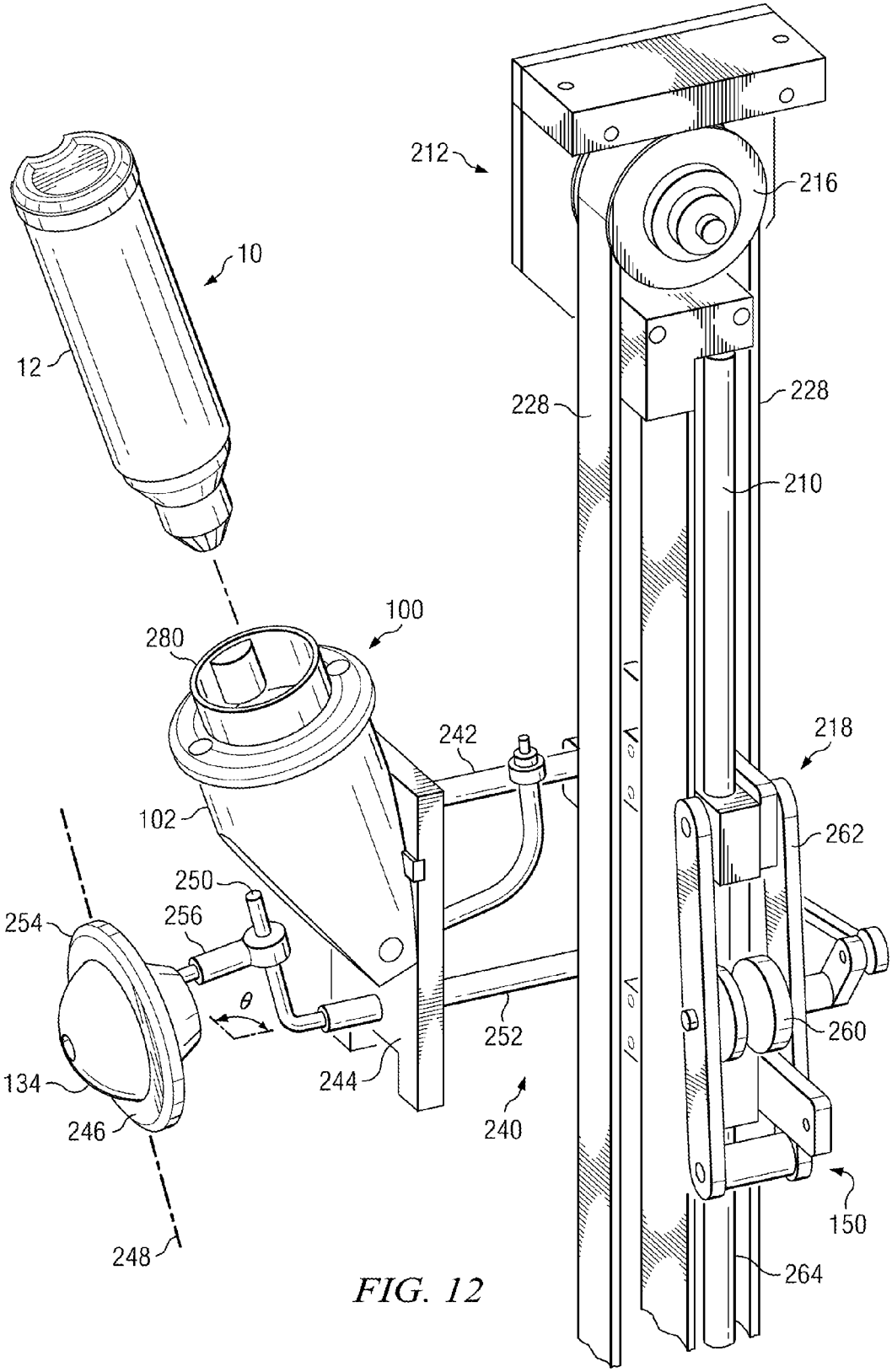
FIG. 12 is another close-up frontal perspective view of the tower sprayer of FIG. 9A.
Figure 13A:
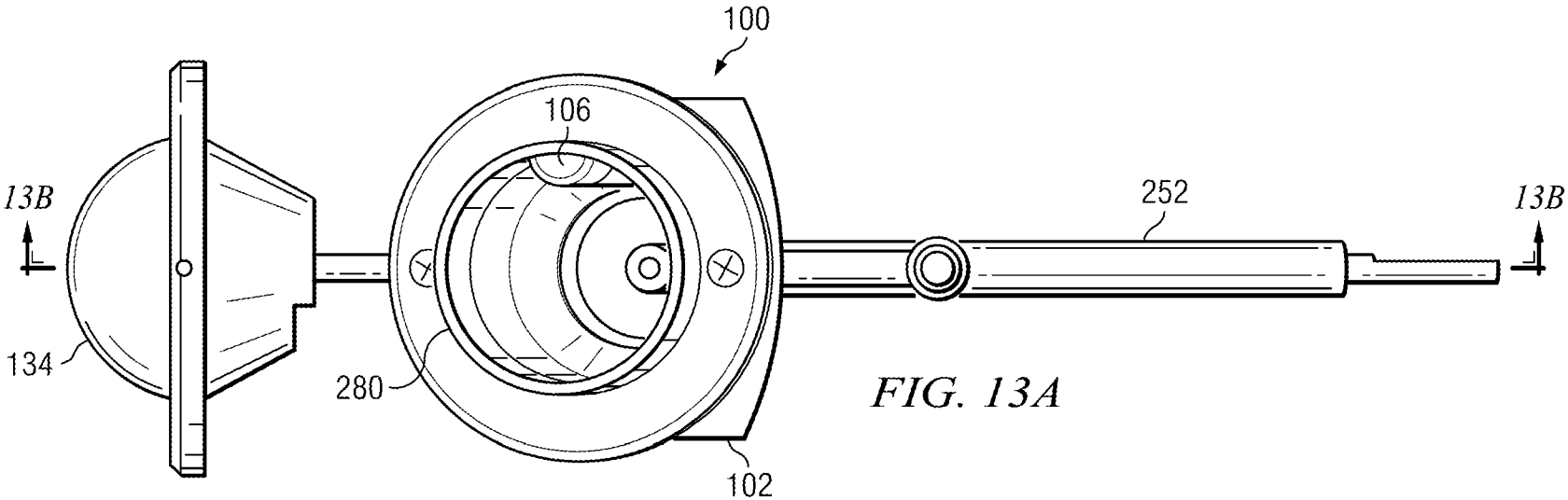
FIG. 13A is a solid top view of the nozzle and receptacle of the tower sprayer of FIG. 9A.
Figure 13B:
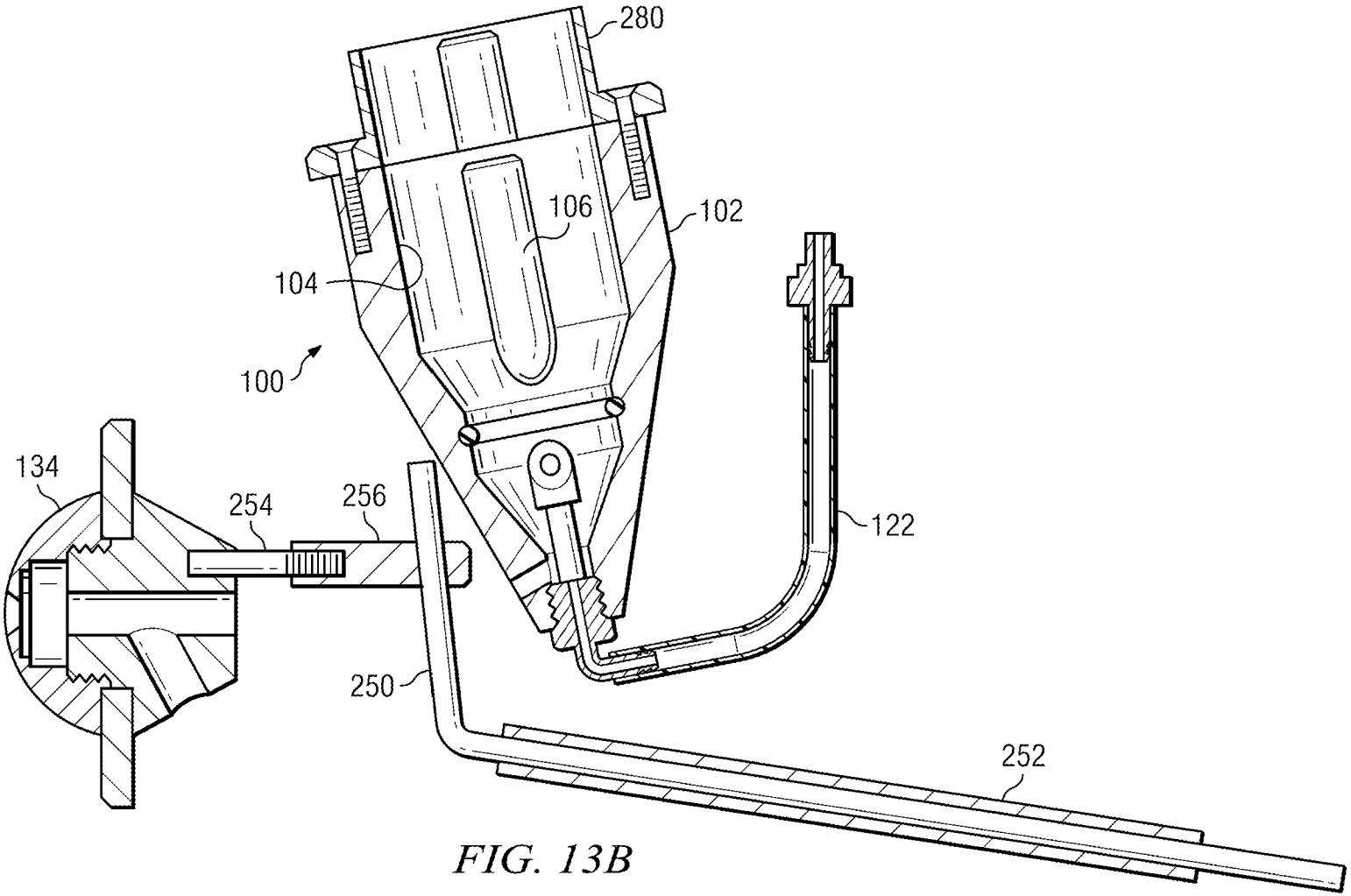
FIG. 13B is a side view of a section A-A of the nozzle and receptacle of FIG. 13A.

Reference is now made to FIGS. 9A-13B wherein there are shown several views of a tower sprayer 200 in accordance with an embodiment of the invention. FIG. 9A is a frontal perspective view of a tower sprayer in accordance with an embodiment of the invention. FIG. 9B is a close-up frontal perspective view of the tower sprayer of FIG. 9A. FIG. 10A is a side view of the tower sprayer of FIG. 9A, and FIG. 10B is a close-up side view of the tower sprayer of FIG. 10A. FIG. 11A is a rearward perspective view of the tower sprayer of FIG. 9A, and FIG. 11B is a close-up rearward perspective view of the tower sprayer of FIG. 11A. FIG. 12 is another close-up perspective view of the tower sprayer of FIG. 9A. FIG. 13A is a solid top view of the nozzle and receptacle of the tower sprayer of FIG. 9A. FIG. 13B is a side view of a section A-A of the nozzle and receptacle of FIG. 13A. The tower sprayer 200 includes a spraying system 156 as described above. It will be noted that tower sprayer 200 is designed to receive a keyed bottle 10 like that shown in FIG. 1. The receptacle 100 and nozzle 134 as described above (and illustrated in FIGS. 3-7) are contained within a housing 202 that also covers part of a mechanism 150 for causing the nozzle 134 to oscillate 154. A translation housing 204 covers the mechanism 150 for causing the nozzle 134 to translate 152, as well as a remaining part of the mechanism 150 for causing the nozzle 134 to oscillate 154. A slot 206 formed by the translation housing 204 allows for vertical translation of the mechanism and defines the path of that translation movement. In FIG. 9A, only a left side of the translation housing 204 is shown. For purposes of clarity, a corresponding right side of the translation housing 204 is not shown.

Figure 9B:
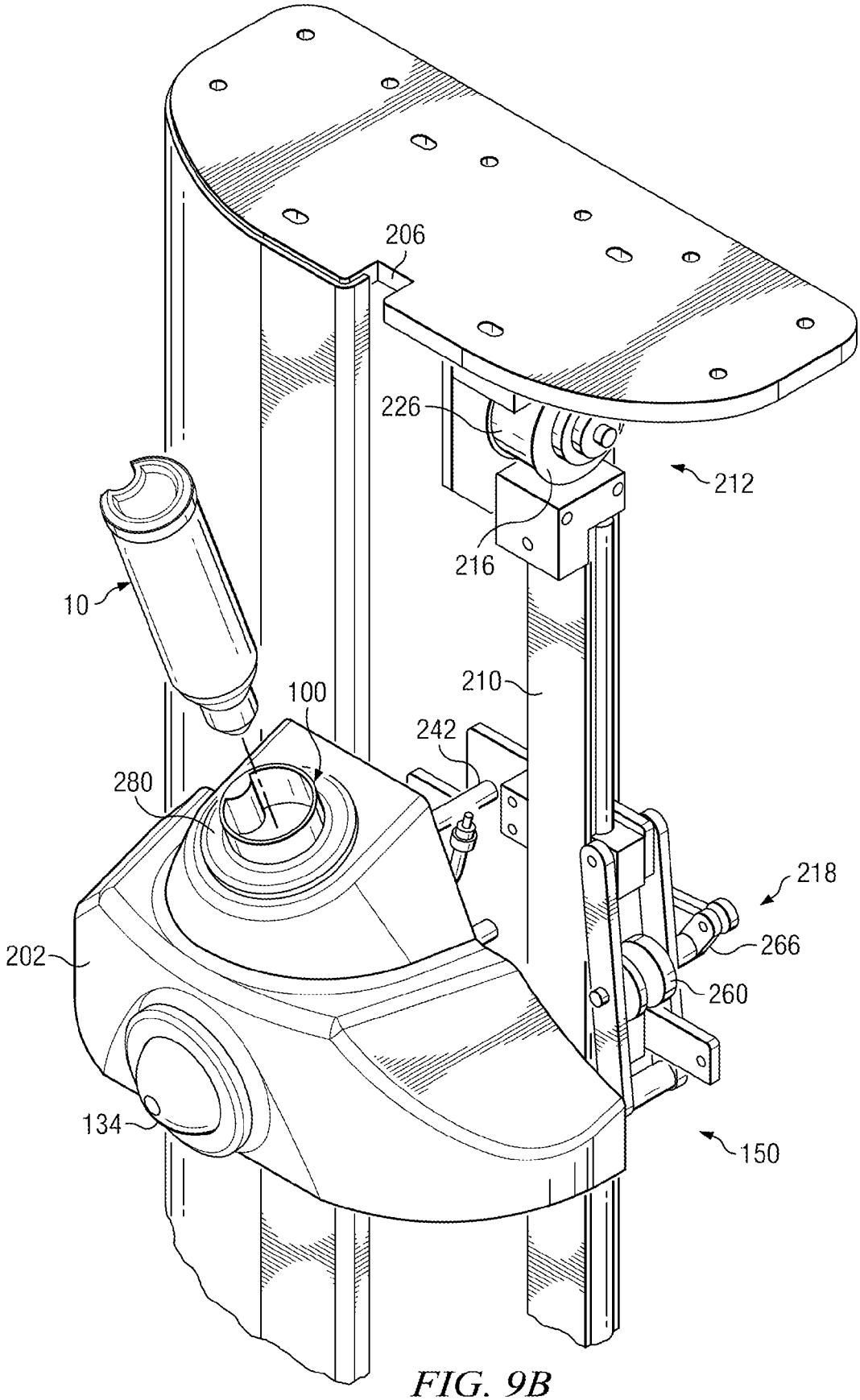
FIG. 9B is a close-up frontal perspective view of the tower sprayer of FIG. 9A.
Figure 10A:
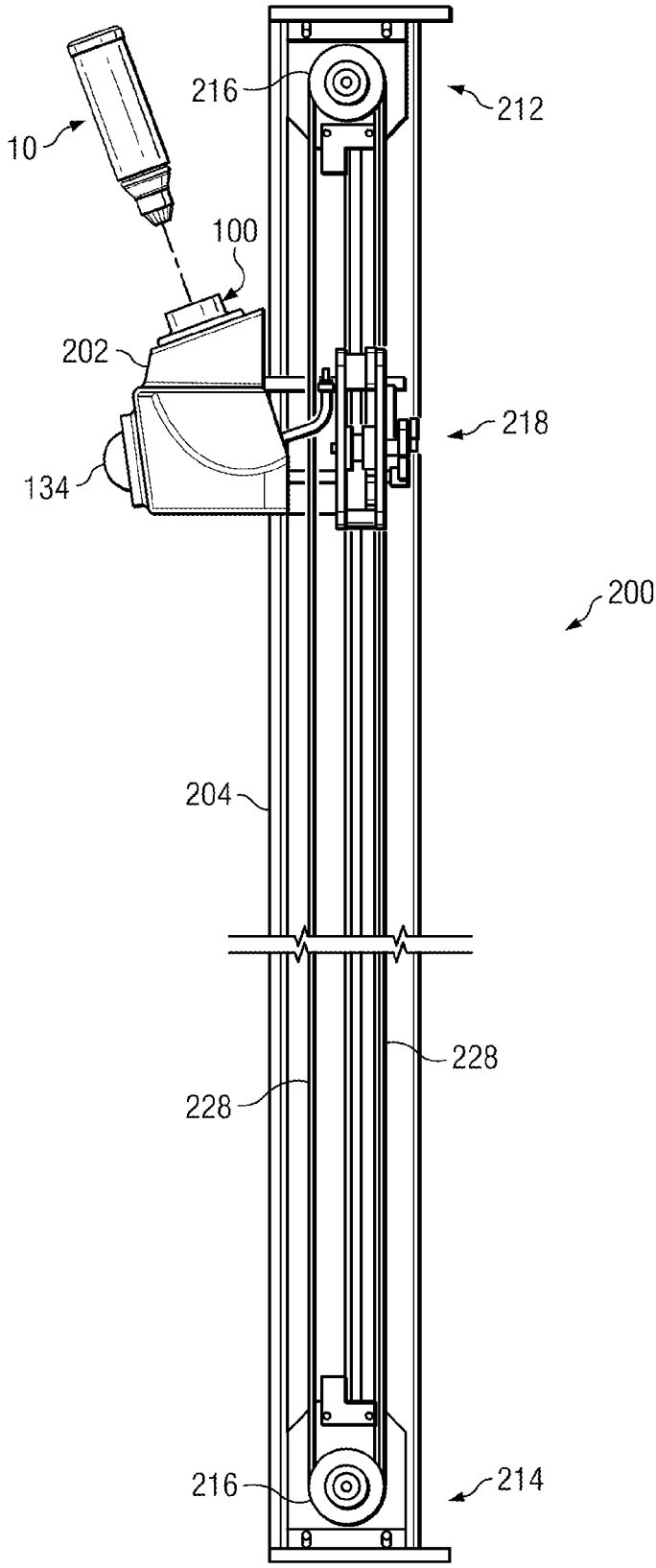
FIG. 10A is a side view of the tower sprayer of FIG. 9A.
Figure 10B:
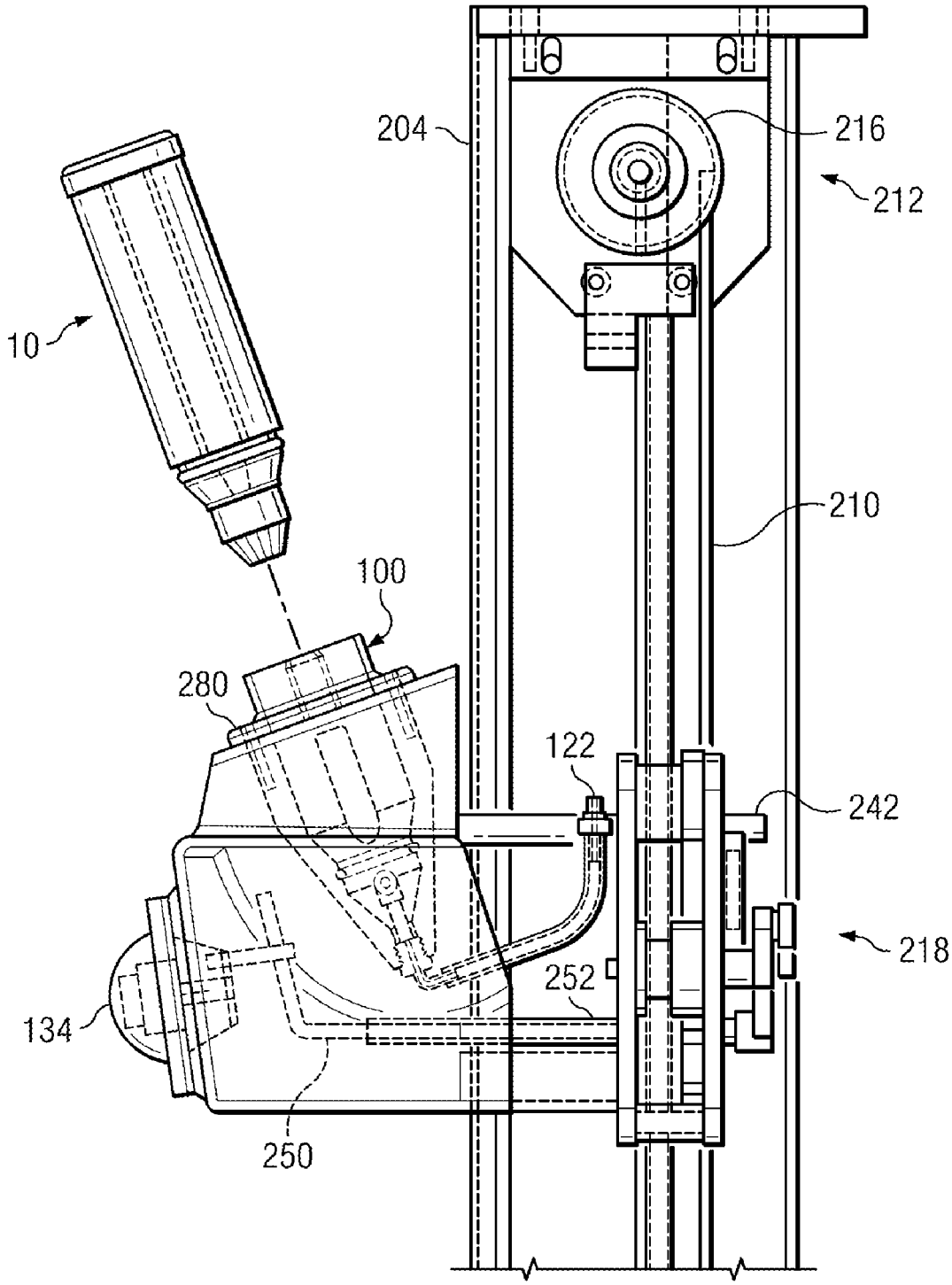
FIG. 10B is a close-up side view of the tower sprayer of FIG. 10A.

A part of the mechanism 150 for supporting oscillation and translation is shown in FIG. 9A which shows a frontal perspective view of the tower sprayer 200, and FIG. 9B which shows a close-up frontal perspective view of the tower sprayer of FIG. 9A. FIG. 11A shows a rearward perspective view of the tower sprayer 200 of FIG. 9A, and FIG. 11B shows a close-up rearward perspective view of the tower sprayer 200 of FIG. 11A. A vertically extending guide rail 210 extends between a top idler pulley assembly 212 and a bottom driver pulley assembly 214. Each pulley assembly 212 and 214 includes a rotatably mounted pulley 216. A motor drive 226 (for example, a gear drive) is mechanically coupled to the bottom driver pulley assembly 214. A drive belt 228 (preferably toothed to match an outer surface of the pulleys 216) is wrapped in loop fashion about the pulleys 216 along the length of the guide rail 210. A trolley 218 is mounted to roll/slide along the guide rail 210. A clamping mechanism 220 is provided on the trolley 218 to clamp to the drive belt. More specifically, each end of the drive belt 228 is secured by the clamp mechanism 220 such that as the drive belt moves in response to motor drive 226 actuation of the pulley 216 within the bottom driver pulley assembly 214, a corresponding linear vertical bi-directional movement of the trolley 218 along the guide rail 210 occurs. The clamping mechanism 220 has an upper and lower piece, 220*u* and 220*l*, respectively, with each piece including a slot 222 defined between two slidable clamp plates into which an end of the drive belt can be inserted. By tightening the clamp plates together the inserted end of the drive belt is retained. One plate of the mechanism 220 is illustrated in FIG. 11B to show ridges 223 which are formed to engage with the teeth in the clamped drive belt 228 and thus further prevent slippage of the belt. A screw adjustment mechanism 224 allows for the tension on the drive belt 228 to be adjusted by altering the relative position of the two slidable clamp plates to each other and thus remove any slack from the belt which might arise over time. In still other embodiments, the belt adjustment mechanism is eliminated.

Reference is now made to FIG. 12 wherein there is shown another frontal perspective view of the mechanism 150 for supporting oscillation and translation. Again, the trolley 218 slides/rolls along the guide rail 210 in response to movement of the drive belt 228 (partially shown wrapped around the top idler pulley assembly 212). A mounting assembly 240 couples the trolley 218 to the receptacle 100 with an offset (perpendicular to the guide rail 210) sufficient enough to position the receptacle 100 outside the translation housing 204. Mounting posts 242 of the mounting assembly 240 pass through the slot 206 formed in the housing 202 which accordingly allows for vertical translation 152 along the translation path. A face plate 244 attached to the mounting posts 242 supports attachment of the receptacle body 102 of the receptacle 100. The nozzle 134 is pivotally mounted to a plate 246 for oscillation about an axis 248. The plate 246 is attached to the cosmetic housing 202. An oscillation actuation lever 250 passes through a support sleeve 252 (also functioning as a mounting post 242) which allows the lever arm to move back and forth across an angle θ. A mounting post 254 is attached to a back of the pivotally supported nozzle 134. A slider 256 has a first end which slidably receives the mounting post 254 and a second end which loops around the lever arm of the actuation lever 250. Back and forth movement of the lever arm is transferred by the slider 156 to the post 254 and nozzle 134 to cause the nozzle to oppositely oscillate about the axis 248. The slidable reception of the post 254 by the slider 256 allows the nozzle oscillation operation to occur without binding.

With reference to FIGS. 9B and 12, a wheel 260 (having a pulley shape) is rotatably supported 262 by the trolley 218 in a position where the wheel contacts an edge 264 of the guide 210. As the trolley 218 is vertically translated (in response to belt 228 actuation), the wheel 260 rotates in a corresponding clockwise or counter-clockwise manner. An arm 266 co-axially mounted to the wheel 260 similarly rotates with wheel rotation. At an opposite end of the actuation lever 250 from the lever arm, an arm 268 is mounted to the lever 250. A bar 270 couples the arm 266 to the arm 268. For each rotation of the arm 266, one back and forth oscillation of the arm 268 with a throw angle of θ is made. This, of course, imparts a corresponding back and forth oscillation of the level arm of the lever 250, and thus causes an opposite oscillation of the nozzle 134 about the axis 248. It will be noted that the positioning of the bar 270 attachment to each of the arms 266 and 268 (i.e., its position distance away from the axis of movement) is adjustable. The adjustments made in positioning set the degree of the throw angle θ for oscillation. Adjustment further can be made to set the number of oscillations which occur per distance the trolley 218 travels along the guide rail 210 by changing the diameter of the wheel 260. The rotatable support mechanism 262 for the wheel 260 is further adjustable to alter the amount of pressure with which the wheel is applied to the edge 264 of the guide rail 210 (this can be accomplished in a number of ways including resistive tightening and spring loading). This pressure adjustment is made to ensure minimal risk of wheel slippage as the trolley 218 moves along the guide 210. The guide rail 210, associated support structures, and the translation mechanism comprise a gantry.

Reference is now made to FIG. 13A wherein there is shown a solid top view of the nozzle and receptacle of the tower sprayer of FIG. 9A. FIG. 13B shows a side view of a section A-A of the nozzle and receptacle of FIG. 13A. As illustrated in FIGS. 13A-13B, the receptacle 100 can be further provided with a mounting flange 280 that facilitates mounting of the receptacle 100 within the housing 202.

In other embodiments of the invention, the mechanisms for supporting oscillation and translation can be comprised of two separate operating mechanisms. For example, a first motor can be used to support the translational movement of the housing 202, and a second motor, operating independently of the first motor, can be used to support the oscillatory movement of the spray nozzle 134.

Figure 14:
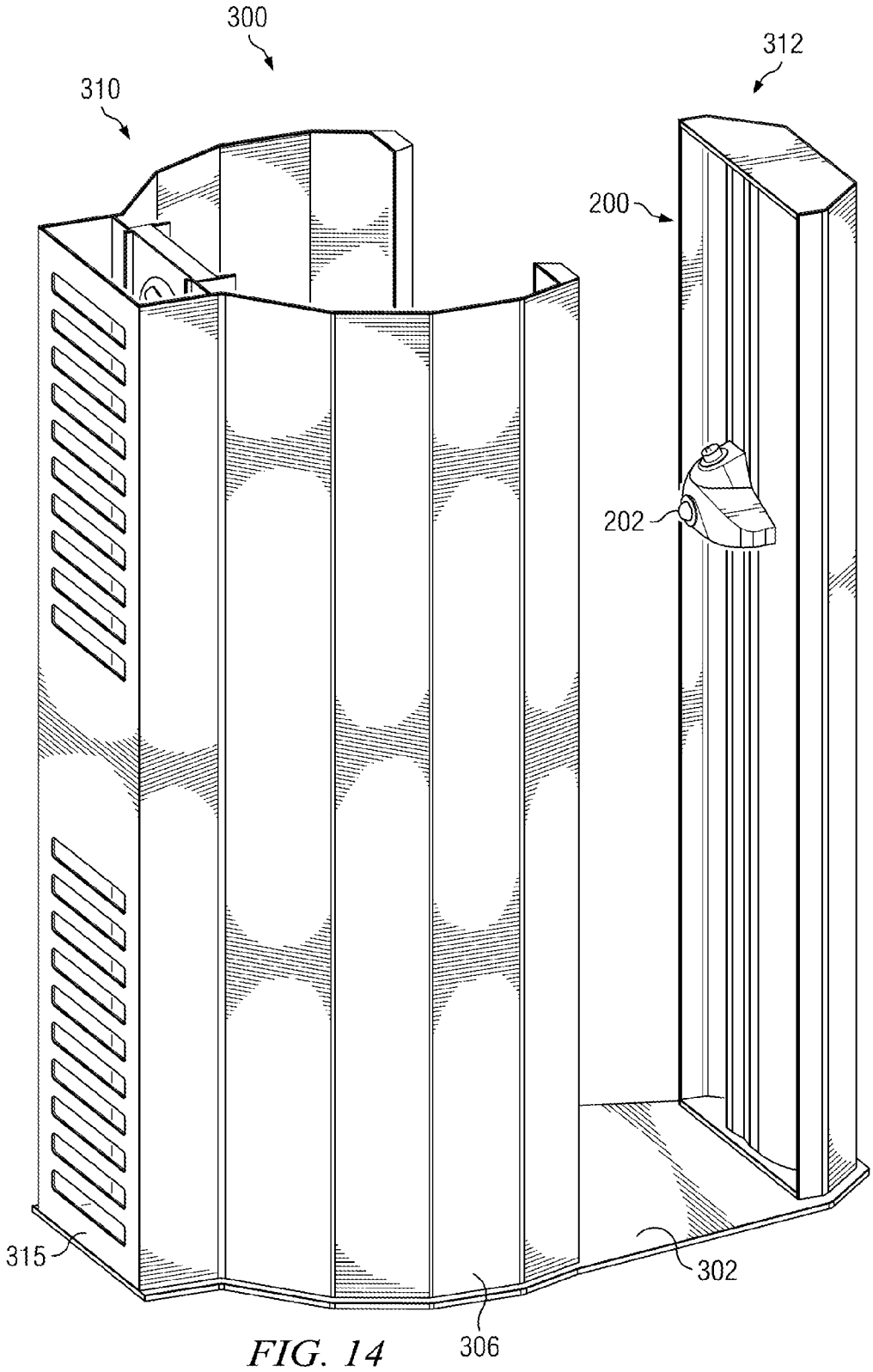
FIG. 14 is a perspective view of a spray booth into which the tower sprayer may be installed.
Figure 15:
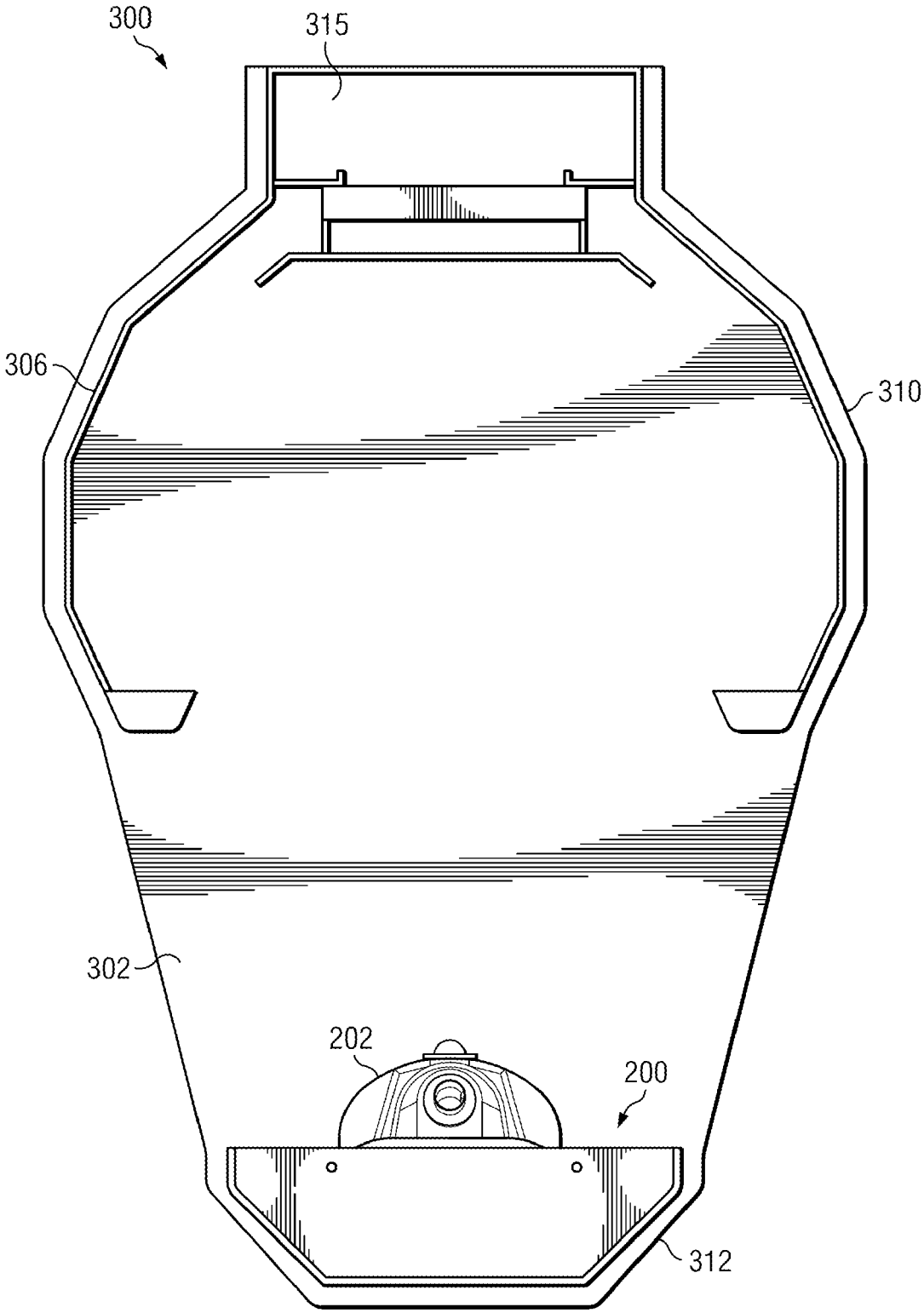
FIG. 15 is a top view of the spray booth of FIG. 14.

Reference is now made to FIG. 14 wherein there is shown a perspective view of a spray booth 300 into which the tower sprayer 200 with its spraying system 156 may be installed. FIG. 15 is a top view of the spray booth of FIG. 14. The booth 300 is of generally conventional design having a floor 302, ceiling (not shown) and an enclosing wall 306. A door (not shown) is provided in the enclosing wall 306 to allow for entry into and exit from the spray booth 300. The booth 300 is sized to comfortably fit a single human being through the door 308 and into a standing position at a wider end 310 of the booth. The tower sprayer 200 is installed within the booth 300 at a narrower end 312 and is oriented so that it sprays generally in the direction of the wider end 310. The booth 300 walls, ceiling, floor and door are preferably made of a plastic material that is easy to clean. The booth 300 is appropriately vented to allow for air flow and facilitate drying. The floor 302 is raised to allow for the inclusion of a drain pan and sump to catch and control collection of fluid/liquid (either from the tower sprayer 200 or otherwise). Operation of booth 300, and its included tower sprayer and spraying system, is preferably touchless controlled in accordance with the disclosure of U.S. patent application Ser. No. 11/264,545 filed Nov. 1, 2005, the disclosure of which is hereby incorporated by reference. The power supply 140 and air supply 132 (FIG. 6) can be installed in the booth (for example, in a mechanical closet on a back side, or accessible from inside the booth) or provided externally to the booth and connected thereto. The booth is further provided with an exhaust system 315 having one or more exhaust fans that functions to exhaust spray liquid from the booth.

In operation, a customer would select a bottle 10 from a rack of bottles. The rack would display bottles 10 containing various kinds of skin coating solutions (such as, for example, sunless tanning compounds, skin moisturizers, medicines, decontaminates and sun screens). Each bottle 10 would preferably contain only as much solution as is needed to coat the purchaser's skin. After having selected the desired bottle 10 and paying for both the bottle and the use of the booth 300, the purchaser would enter the booth and insert the bottle (minus the cap 46) into the receptacle 100. Importantly, due to the keyed feature, the receptacle would be configured to accept only correspondingly keyed bottles purchased on site. This prevents a customer from bringing their own solution for application using the tower sprayer 200 or prevents the use of solution marketed by unauthorized vendors. Assuming the keyed feature matches, the bottle will be accepted into the bore 104 of the receptacle 100. By fully inserting the bottle, the customer causes the seal 32 to be punctured allowing the contained fluid/liquid to be released and pool in the chamber portion 114 at the base of the bore 104. The customer then would activate the tower sprayer 200. The voltage supply 140 and air supply 132 would then turn on. The flow of air through the nozzle causes fluid to be drawn from the chamber portion 114 at the base of the bore 104 by venturi effect. The drawn fluid/liquid mixes with the air and is atomized to form the charged spray cloud 138. At the same time, the mechanism 150 for supporting oscillation and translation is actuated causing the nozzle 134 to be vertically translated and horizontally oscillated while spraying occurs. The generated spray cloud is electrostatically charged by the voltage supply, and the contained spray droplets are attracted to the human who is standing nearby and minimal spray is accordingly deposited on the walls of the booth 300. Due to the vertical translation and horizontal oscillation, an even coating of the solution will be applied. To obtain coverage all over the human, more than one vertical translation pass may be necessary. If so, the purchaser may further be instructed, between passes, to rotate or otherwise shift their position. Operation of the spraying system 156 may be temporarily paused to allow for position shifting. When the bottle is emptied of fluid/liquid, the session ends and the purchaser may exit the booth 300. Following completion of the session, the booth may be cleaned if necessary. Otherwise, a next customer can be invited in for a session. The emptied bottle may then be disposed of The spray system in accordance with various embodiments of the present invention allows for a spraying motion that mimics that of a hand held sprayer in that it allows for side to side motion while simultaneously traveling in an up and down motion to give the spray the same action as that of a hand held spray gun. This provides for a more precise application of spray liquid as compared to existing automated spray booths.

The spray system of the present invention also provides an advantage over system which use spray bars with many nozzles, hoses, valves, etc., as these spray bars are heavy and potentially dangerous due to the greater likelihood of a person getting caught in such devices.

In accordance with an embodiment of the invention, the tower sprayer is provided with at least one programmable controller that controls the speed and position of the drive motor as well as the oscillatory movement of the spray nozzle. The programmable controller allows for selective spraying of more or less of the spray liquid on certain areas of the human skin. For example, the spraying movement can be made to speed up or slow down at certain locations with respect to certain portions of the body, or spray may be repeated over certain body regions.

It should be emphasized that the terms "comprise", "comprises", and "comprising", when used herein, are taken to specify the presence of stated features integers, steps, or components, but do not preclude the presence or addition of one or more other features, integers, steps, components or groups thereof.

In the foregoing Detailed Description, it can be seen that various features may be grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment. The scope of the invention is defined by the following claims and the equivalents thereof.

What is claimed is:

1. A spray system for dispensing a cosmetic liquid for skin treatment, the spray system comprising:

a bottle comprising:

a bottle body configured to contain a cosmetic liquid for skin treatment;

a neck including an opening for dispensing the cosmetic liquid from the bottle body; and a seal affixed to the neck of the bottle and configured to close the opening; and a receptacle comprising:

a receptacle body having an inner surface defined by a central bore, the inner surface being of a size and shape to generally conform to the size and shape of the bottle;

a hollow needle at a base of the central bore configured to puncture the seal affixed to the neck of the bottle; and a tube coupled to the hollow needle and configured to supply air into the bottle through the hollow needle so as to facilitate draining of the cosmetic liquid into the receptacle body; and a spray nozzle connected to a drain opening in the receptacle body by a fluid channel configured to convey the drained cosmetic liquid from the receptacle body to the spray nozzle.

2. The spray system of claim 1, wherein the bottle is a keyed bottle including a keying mechanism longitudinally extending along at least a portion of the bottle body, the keying mechanism comprising a longitudinal extending channel formed in an exterior surface the bottle body.

3. The spray system of claim 1, wherein the bottle is sized to contain a volume of the cosmetic liquid not to exceed an amount needed for a single spraying session use.

4. The spray system of claim 1, wherein the bottle is a keyed bottle including a keying mechanism longitudinally extending along at least a portion of the bottle body, the receptacle including a key structure extending along a portion of the inner surface of the receptacle body, the key structure configured to engage the keying mechanism of the keyed bottle; the key structure comprising a cylindrical rod forming a ridge with an exposed hemispherical surface, the cylindrical rod being aligned with the key mechanism of the keyed bottle when the keyed bottle is inserted into the receptacle body.

5. The spray system of claim 1, wherein the central bore of the receptacle body defines a chamber portion located above the base of the central bore for receiving the cosmetic liquid drained from of the bottle upon insertion of the bottle into the receptacle body and puncturing of the seal.

6. The spray system of claim 5, further comprising a seal ring positioned within the chamber portion to seal against an outer surface portion of the keyed bottle upon insertion of the keyed bottle into the receptacle body.

7. The spray system of claim 1 further comprising:

a housing adapted to contain at least a portion of the receptacle and at least a portion of the spray nozzle.

8. The spray system of claim 7 further comprising:

a translation mechanism coupled to the housing, the translation mechanism adapted to cause translational movement of the housing.

9. The spray system of claim 7, further comprising oscillation mechanism coupled to the spray nozzle, the oscillation mechanism adapted to cause oscillation of the spray nozzle.

10. A spray system for dispensing a cosmetic liquid for skin treatment, the spray system comprising:

a receptacle comprising a liquid chamber configured to receive a bottle containing a cosmetic liquid for skin treatment, the liquid chamber including a drain opening at a base thereof and a hollow needle extending from the base thereof, said hollow needle configured to puncture a seal of the received bottle, said hollow needle further passing air into the bottle through the hollow needle so as to facilitate draining of the cosmetic liquid from the received bottle and into the liquid chamber;

a spray nozzle coupled to the drain opening in the liquid chamber for receiving the drained cosmetic liquid from the receptacle and dispensing the cosmetic liquid in a spray;

a housing for containing at least a portion of the receptacle and at least a portion of the spray nozzle; and a mechanism adapted to cause movement of the spray emitted of the spray nozzle.

11. The spray system of claim 10, wherein the mechanism produces a translational movement of the housing simultaneously with an oscillation movement of the spray nozzle.

12. The spray system of claim 10, wherein the mechanism produces a translational movement that comprises a bidirectional translational movement.

13. The spray system of claim 10, wherein the mechanism further comprises:

a guide rail; and a trolley having a first side coupled to the guide rail and a second side coupled to the housing such that the trolley can slide along the guide rail to facilitate a translational movement of the housing.

14. The spray system of claim 13, further comprising:

a first pulley assembly coupled to a first end of the guide rail;

a second pulley assembly coupled to a second end of the guide rail;

a guide belt wrapped along the first pulley assembly and the second pulley assembly, the guide belt coupled to the trolley to facilitate the translational movement.

15. The spray system of claim 14, further comprising:

a motor drive coupled to the first pulley assembly, the first pulley assembly causing movement of the guide belt in response to actuation of the motor drive.

16. The spray system of claim 13 further comprising:

a wheel rotationally supported by the trolley, the wheel contacting an edge of the guide rail such that translational movement of the trolley imparts rotation to the wheel;

an actuation lever coupled to the spray nozzle;

a first arm axially mounted to the wheel;

a second arm coupled to the actuation lever; and a bar coupling the first arm to the second arm, wherein the rotation of the wheel imparts rotation of the first arm, the rotation of the first arm producing an oscillatory movement of the second arm.

17. The spray system of claim 16, wherein the oscillatory movement of the second arm imparts an oscillatory movement of the actuation lever, the oscillatory movement of the actuation level causing an oscillation of the spray nozzle.

18. The spray system of claim 10, wherein the receptacle comprises:

the liquid chamber having an inner surface defined by a central bore, the inner surface being of a size and shape to generally conform to the size and shape of a keyed bottle containing the cosmetic liquid; and a key structure extending along a portion of the inner surface, the key structure for engaging a keying mechanism of the keyed bottle, the keying mechanism being of a size and shape to conform to the size and shape of the key structure.

19. The spray system of claim 18, wherein the key structure comprises a cylindrical rod forming a ridge with an exposed hemispherical surface, the cylindrical rod being aligned with the key mechanism of the keyed bottle when the keyed bottle is inserted into the receptacle body.

20. The spray system of claim 18, wherein the keying mechanism of the keyed bottle comprises a longitudinal extending channel formed in an exterior surface the keyed bottle.

21. The spray system of claim 18, wherein the keyed bottle is sized to contain a volume of the cosmetic liquid not to exceed an amount needed for a single spraying session use.

22. The spray system of claim 10, wherein the liquid chamber has an inner surface defined by a central bore, and further including a seal ring along the inner surface for sealing against the bottle upon insertion of the bottle into the receptacle body, said sealing precluding liquid drained from the bottle from overflowing out of the liquid chamber.

23. The spray system of claim 10, further comprising a vent tube coupled to the hollow needle for allowing the venting air to enter the bottle through the hollow needle to facilitate draining of the cosmetic liquid into the liquid chamber.

24. The spray system of claim 10, wherein the receptacle body further comprises a fluid channel for conveying the cosmetic liquid from the drain opening to the spray nozzle.

25. The spray system of claim 10 further comprising:

a controller to control the movement of the spray emitted from the spray nozzle.

26. The spray system of claim 10 further comprising:

a spray booth for containing the receptacle, the spray nozzle, the housing, and the mechanism.

27. A spray system for dispensing a cosmetic liquid for skin treatment, the spray system comprising:

a gantry;

a spray assembly coupled to the gantry and adapted for translational movement along the gantry, the spray assembly comprising:

a receptacle configured to receive a cartridge having an outer surface, the cartridge for containing a cosmetic liquid for skin treatment;

the receptacle defining a chamber having an inner surface of a size and shape to generally conform to a size and shape of a portion of the outer surface of the cartridge, the chamber having a base, a drain opening in the base and a hollow needle extending from the base, the hollow needle configured to puncture a seal on the cartridge in a manner permitting the cosmetic liquid to drain from the cartridge and fill the chamber of the receptacle, said hollow needle further passing air from external to the cartridge to enter the cartridge through the hollow needle; and a spray nozzle coupled to the drain opening in the chamber for receiving the drained cosmetic liquid from the receptacle and dispensing the cosmetic liquid in a spray.

28. The spray system of claim 27 further comprising:

an oscillation mechanism coupled to the spray nozzle, the oscillation mechanism adapted to cause oscillation of the spray nozzle.

29. The spray system of claim 27, wherein the gantry further comprises:

a translation mechanism coupled to the spray assembly, the translation mechanism adapted to cause the translational movement of the spray assembly.

30. The spray system of claim 27, wherein the chamber has an inner surface defined by a central bore, and further including a seal ring along the inner surface for sealing against the cartridge upon insertion of the cartridge into the receptacle, said sealing precluding liquid drained from the cartridge from overflowing out of the chamber.

31. The spray system of claim 27, wherein the cartridge is sized to contain a volume of the cosmetic liquid not to exceed an amount needed for a single spray session use.

32. The spray system of claim 27, wherein the cartridge comprises a reusable cartridge.

33. The spray system of claim 27, wherein the cartridge comprises a refillable cartridge.

34. A spray system for dispensing a cosmetic liquid for skin treatment, the spray system comprising:

a gantry; and a spray assembly coupled to the gantry and adapted for translational movement along the gantry in a first direction, the spray assembly comprising:

a housing;

a receptacle contained within at least a portion of the housing, the receptacle configured to receive a cartridge containing a cosmetic liquid for skin treatment, the receptacle including a liquid chamber having an inner surface of a size and shape to generally conform to a size and shape of a portion of the outer surface of the cartridge;

wherein the liquid chamber includes a base, a drain opening formed in the base and a hollow needle extending from the base, the hollow needle configured with a shape to puncture a seal of the received cartridge in a manner permitting cosmetic liquid to drain from the cartridge around an outer surface of the hollow needle and into the liquid chamber while passing air from external to the cartridge into the cartridge through the hollow needle; and a spray nozzle mounted within at least a portion of the housing, the spray nozzle being coupled to the receptacle for receiving the cosmetic fluid from the receptacle and dispensing the cosmetic fluid in a spray in at least a second direction.

35. The spray system of claim 34 further comprising:

an oscillation mechanism coupled to the spray nozzle, the oscillation mechanism adapted to cause an oscillating dispensing of the cosmetic fluid by the spray nozzle.

36. The spray system of claim 34, wherein the gantry further comprises:

a translation mechanism coupled to the spray assembly, the translation mechanism adapted to cause the translational movement of the spray assembly in the first direction.

37. The spray system of claim 34, wherein the liquid chamber has an inner surface defined by a central bore, and further including a seal ring along the inner surface for sealing against the cartridge upon insertion of the cartridge into the receptacle, said sealing precluding liquid drained from the cartridge from overflowing out of the liquid chamber.

38. The spray system of claim 34, wherein the cartridge is sized to contain a volume of the cosmetic liquid not to exceed an amount needed for a single use.

39. The spray system of claim 34, wherein the first direction is perpendicular to the second direction.

* * * * *

UNITED STATES PATENT AND TRADEMARK OFFICE

CERTIFICATE OF CORRECTION

PATENT NO. : 7,992,517 B2
APPLICATION NO. : 12/686059
DATED : August 9, 2011
INVENTOR(S) : Cooper et al.

It is certified that error appears in the above-identified patent and that said Letters Patent is hereby corrected as shown below:

In the Claims:

At column 5, claim number 5, line number 17, please replace the phrase [drained from of the bottle] with the phrase -- drained from the bottle --.

At column 5, claim number 10, line number 51, please replace the word [of] with the word -- from --.

Signed and Sealed this
Thirteenth Day of September, 2011

David J. Kappos

David J. Kappos
*Director of the United States Patent and Trademark Office*